US006604664B2

(12) United States Patent
Robinson

(10) Patent No.: US 6,604,664 B2
(45) Date of Patent: Aug. 12, 2003

(54) SAFE TRIGGER WITH TIME DELAY FOR PNEUMATIC FASTENER DRIVING TOOLS

(75) Inventor: James W. Robinson, Mundelein, IL (US)

(73) Assignee: Illinois Tool Works Inc., Glenview, IL (US)

( * ) Notice: Subject to any disclaimer, the term of this patent is extended or adjusted under 35 U.S.C. 154(b) by 235 days.

(21) Appl. No.: 09/761,346

(22) Filed: Jan. 16, 2001

(65) Prior Publication Data

US 2002/0125290 A1 Sep. 12, 2002

(51) Int. Cl.[7] ..... B25C 1/04
(52) U.S. Cl. ..... 227/8; 227/130; 227/120
(58) Field of Search ..... 227/8, 130, 7, 227/6, 120, 129, 127

(56) References Cited

U.S. PATENT DOCUMENTS

| | | | | |
|---|---|---|---|---|
| 3,888,404 A | | 6/1975 | Ramspeck et al. | |
| 4,405,071 A | | 9/1983 | Austin | |
| 4,550,643 A | | 11/1985 | Schwartzenberger | |
| 4,936,192 A | * | 6/1990 | Johnsson et al. | 91/217 |
| 5,522,531 A | * | 6/1996 | Ogawa | 227/8 |
| 5,669,542 A | * | 9/1997 | White | 227/8 |
| 5,782,395 A | * | 7/1998 | Sauer | 227/130 |
| 5,918,788 A | * | 7/1999 | Moorman et al. | 227/8 |
| 6,095,392 A | * | 8/2000 | Batts, Jr. et al. | 227/8 |

FOREIGN PATENT DOCUMENTS

JP 02339604 11/1990

* cited by examiner

*Primary Examiner*—Rinaldi I. Rada
*Assistant Examiner*—Tara Ho
(74) *Attorney, Agent, or Firm*—Schwartz & Weinrieb

(57) ABSTRACT

A pneumatic fastener-driving tool is disclosed wherein not only rapid-fire bump-firing or trigger-firing modes of operation are permitted wherein either one of the trigger member and workpiece contact element components can be depressed before the other one of the trigger member and workpiece contact element components depending upon the particular mode of operation that the operator personnel chooses to employ, however, the tool is also rendered safe for transportation by operator personnel between job sites or work sites in view of the fact that if the workpiece contact element is not depressed, as a result of not being disposed in contact or engagement with a workpiece, within a predetermined period of time subsequent to the performance of the last fastener discharge or firing operation, then the tool is pneumatically disabled and can only be again enabled if the proper sequential activation of the tool is performed wherein the workpiece contact element must be engaged with a workpiece prior to the depression or activation of the tool trigger. Accordingly, after the expiration or lapse of the aforenoted predetermined period of time, should the operator personnel carry or transport the tool with the trigger member nevertheless depressed, the tool will not fire or discharge a fastener even if the workpiece contact element is depressed due to the fact that the tool has already been pneumatically disabled.

39 Claims, 12 Drawing Sheets

SAFE TRIGGER WITH TIME DELAY FOR PNEUMATIC FASTENER DRIVING TOOLS

FIELD OF THE INVENTION

The present invention relates generally to pneumatic fastener driving tools, and more particularly to a new and improved pneumatic fastener driving tool wherein the tool has incorporated therein a control system which ensures the safe operation of the tool while effectively permitting the operation of the tool within either one of two rapid fire modes.

BACKGROUND OF THE INVENTION

Pneumatic fastener driving tools are well known in the art and are exemplified by means of U.S. Pat. No. 4,550,643 which issued to Schwartzenberger on Nov. 5, 1985, U.S. Pat. No. 4,405,071 which issued to Austin on Sep. 20, 1983, and U.S. Pat. No. 3,888,404 which issued to Ramspeck et al. on Jun. 10, 1975. Such fastener driving tools conventionally incorporate therein trigger and workpiece contact mechanisms both of which must be activated in order to achieve the discharge or firing of a fastener from the tool. More particularly, a mechanical linkage is operatively connected to a pilot valve such that activation of the pilot valve by means of the mechanical linkage causes the fastener driving tool to cycle and thereby discharge or fire a fastener. The linkage is constructed in such a manner that the movement required to activate the pilot valve is derived from the combined movements of the trigger and workpiece contact mechanisms, although the trigger and workpiece contact mechanisms do not have to be depressed or actuated in any particular manner or order.

Accordingly, if, for example, an operator manipulates or holds the tool in such a manner that the workpiece contact element or mechanism of the tool is constantly maintained in contact with the workpiece or structure, then the tool can discharge or fire a fastener whenever the trigger element or mechanism is also depressed. This mode of operation of the tool is commonly known or referred to as "trigger firing" and obviously provides the operator with a first mode of operation or means for achieving a high level of productivity. This mode of operation is also appreciated to be inherently safe because the workpiece contact element or mechanism is always disposed in contact with a workpiece prior to depression or actuation of the trigger element or mechanism. Alternatively, if, for example, the operator grasps the fastener driving tool by means of its handle in such a manner that the trigger element is constantly depressed, then the tool can discharge or fire a fastener whenever the workpiece contact element is also depressed. This mode of operation of the tool is commonly known or referred to as "bump-firing" and provides the operator with a second mode of operation or means for achieving a high level of productivity. The obvious disadvantage of this mode of operation of the tool is that the tool can be accidentally, inadvertently, or unintentionally discharged or fired if, for example, while the operator is carrying or transporting the tool between different worksites, and while the trigger element is depressed, the workpiece contact element of the tool is inadvertently, accidentally, or unintentionally depressed such as, for example, when the workpiece contact element is accidentally, inadvertently, or unintentionally engaged or moved into contact against some relatively solid object, including the operator, another person, or onsite worker, other than an intended workpiece.

Accordingly, safer versions of pneumatic fastener driving tools require that the trigger and workpiece contact elements of the tool be depressed in a particular order in order to discharge or fire the tool, that is, the workpiece contact element must first be depressed against an intended workpiece, and subsequently, the trigger element must then be actuated. This mode of operation of the fastener driving tool is commonly known or referred to as "sequential firing". Mechanical linkages incorporated within such tools therefore require that the trigger mechanism must be released and subsequently again depressed or actuated each time a fastener is to be discharged or fired. While the operation of this type of fastener driving tool is thus rendered safer than the previously noted "bump-fire" type of fastener driving tool, it can be readily appreciated that this type of fastener driving tool does not permit the tool operator to achieve a level of productivity which is comparable to that achieved by means of the aforenoted type of fastener driving tool which is being operated in the "bump-firing" mode.

Accordingly, a need exists in the art for a new and improved pneumatic fastener driving tool wherein the trigger and workpiece contact elements are not required to be depressed or actuated in a particular manner or order whereby the tool is able to be operated in both high-speed bump-fire and trigger-fire modes of operation, and yet, the tool is also able to be operated in a safe manner so as to prevent the inadvertent, accidental, or unintentional discharge or firing of the tool despite the fact that an operator may carry or transport the tool between different worksites with the trigger element constantly depressed.

OBJECTS OF THE INVENTION

Accordingly, it is an object of the present invention to provide a new and improved pneumatic fastener driving tool.

Another object of the present invention is to provide a new and improved pneumatic fastener driving tool which effectively overcomes the various disadvantages and operational drawbacks characteristic of PRIOR ART pneumatic fastener driving tools.

An additional object of the present invention is to provide a new and improved pneumatic fastener driving tool which is able to be operated in either one of two high-speed bump-fire and trigger-fire operational modes.

A further object of the present invention is to provide a new and improved pneumatic fastener driving tool which is in effect a hybrid type pneumatic fastener driving tool in that the tool is able to be operated in either one of two high-speed bump-fire and trigger-fire operational modes and yet, under certain circumstances, in order to render the tool safe during periods in which fasteners are not to be discharged or fired, the tool cannot be recycled or again discharged or fired unless the tool is initially activated in accordance with a sequential firing mode of operation subsequent to which the tool can also again be discharged or fired in either one of the two high-speed bump-fire or trigger-fire operational modes so as to achieve the desirable high level of productivity.

SUMMARY OF THE INVENTION

The foregoing and other objectives are achieved in accordance with the teachings and principles of the present invention through the provision of a new and improved pneumatic fastener driving tool which comprises a housing within which a main valve is disposed and which is adapted to be vented through means of a pilot valve assembly. A workpiece contact element linkage mechanism is operatively connected to a fill valve which is movable so as to fluidically connect the interior of the tool handle, into which compressed air is conducted by means of a suitable fitting, to a reservoir tank. The reservoir tank is in turn fluidically connected to an enable valve assembly so as to provide signal air thereto, and a trigger element or mechanism is operatively connected to the pilot valve assembly as well as to a relief valve assembly.

Accordingly, and initially, when the workpiece contacting element is engaged with a workpiece prior to the depression of the tool trigger element or mechanism, the compressed air is permitted to enter the reservoir tank through means of the fill valve so as to provide the reservoir tank with pressurized reservoir air, the pressurized reservoir air maintains the relief valve assembly closed and is also conducted to the enable valve assembly by means of a signal line, and the compressed air also pressurizes the main valve through means of the pilot valve assembly and the enable valve assembly. Upon subsequent depression of the trigger element or mechanism, the pilot valve assembly is opened, the pressurized reservoir air maintains the relief valve assembly closed against the biasing force of the trigger element or mechanism, and the air signal from the reservoir tank to the enable valve assembly maintains the enable valve assembly opened such that the main valve is able to be vented through means of the enable valve assembly and the pilot valve assembly whereby a fastener is able to be fired or discharged. If the trigger element or mechanism is depressed prior to the engagement of the workpiece contacting element with a workpiece, the reservoir tank is not sufficiently pressurized, the pressure level within the reservoir tank is therefore insufficient to maintain the relief valve assembly closed or to actuate the enable valve assembly, the relief valve assembly is thus opened, and when the workpiece contacting element is subsequently engaged with the workpiece and thereby also opens the fill valve, the compressed air is immediately vented through the relief valve assembly whereby the tool will not fire or discharge. Consequently, in order to initially activate or operate the tool, the tool must be operated in a sequential firing mode comprising the engagement of the workpiece contacting element or mechanism with a workpiece prior to the actuation or depression of the trigger element or mechanism. Subsequent to such an initial activation or operation of the tool, additional operational cycles of the tool, wherein additional fasteners are able to be fired or discharged, can in fact be achieved regardless of whether or not the trigger element or mechanism is depressed prior to the contact or engagement of the workpiece contacting element or mechanism with a workpiece. This is because sufficient pressurized air is already contained and retained within the reservoir tank, such pressurized reservoir air maintains the relief valve assembly closed and is able to supply signal air to the enable valve assembly, and in addition, such pressurized reservoir air is additionally replenished or supplemented through the fill valve every time the workpiece contacting element or mechanism is engaged with a workpiece whereby the fill valve is actuated.

In this manner, the rapid fire modes of operation, comprising either the "bump-firing" or "trigger-firing" modes of operation, can be achieved. As has been noted hereinbefore, the "trigger-firing" mode of operation of the tool is inherently safe because each time the trigger element or mechanism is depressed so as to fire or discharge the tool, the workpiece contact element or mechanism is already disposed in contact with the workpiece. In order to render the tool safe, however, when the tool is being operated in the "bump-firing" mode, whereby the inadvertent, accidental, or unintentional firing or discharge of the tool is to be effectively prevented, a bleed orifice is fluidically connected to the reservoir tank whereby the pressurized reservoir air is constantly but slowly bled from the reservoir tank. Therefore, in order for the tool to be fired or discharged, sufficient pressurized air must be maintained within the reservoir tank so as to maintain the relief valve assembly closed and to provide the necessary signal air to the enable valve assembly when the workpiece contact element or mechanism is subsequently depressed such that the workpiece contact element or mechanism, along with the trigger element or mechanism which is already depressed, activates the pilot valve assembly. Sufficient pressurized air is only maintained within the reservoir tank by means of the actuation of the fill valve as a result of the actuation or depression of the workpiece contact element or mechanism against a workpiece.

Therefore, if the workpiece contact element or mechanism is again depressed against or disposed in contact or engagement with a workpiece within a predetermined period of time after its previous contact or engagement with a workpiece, sufficient pressurized air will again be introduced into the reservoir tank, or in other words, the pressurized air within the reservoir tank will have been replenished. However, if the workpiece contacting element or mechanism is not depressed or disposed in contact with a workpiece within a predetermined amount of time after its previous contact or engagement with a workpiece, whereby the pressurized air present within the reservoir tank has already been bled to a predetermined degree and has not therefore been sufficiently replenished or supplemented by new pressurized air attendant the engagement or contact of the workpiece contacting element or mechanism with a workpiece and the resulting operation of the fill valve, insufficient air pressure is thus retained or present within the reservoir tank, and therefore the relief valve will be opened, the pressurized air within the reservoir tank will be vented, the enable valve will be closed, and the operative firing or discharge cycle of the tool will be rendered inoperative when the tool is to be fired or discharged by means of the depression of the workpiece contact element or mechanism against a workpiece because the pressurized air now introduced into thereservoir tank by means of the fill valve will now be immediately vented through the relief valve assembly. This mode of operation thus renders the tool safe to transport between job sites or work sites despite the fact that the operator may carry or transport the tool by means of the handle with the trigger element or mechanism constantly depressed.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
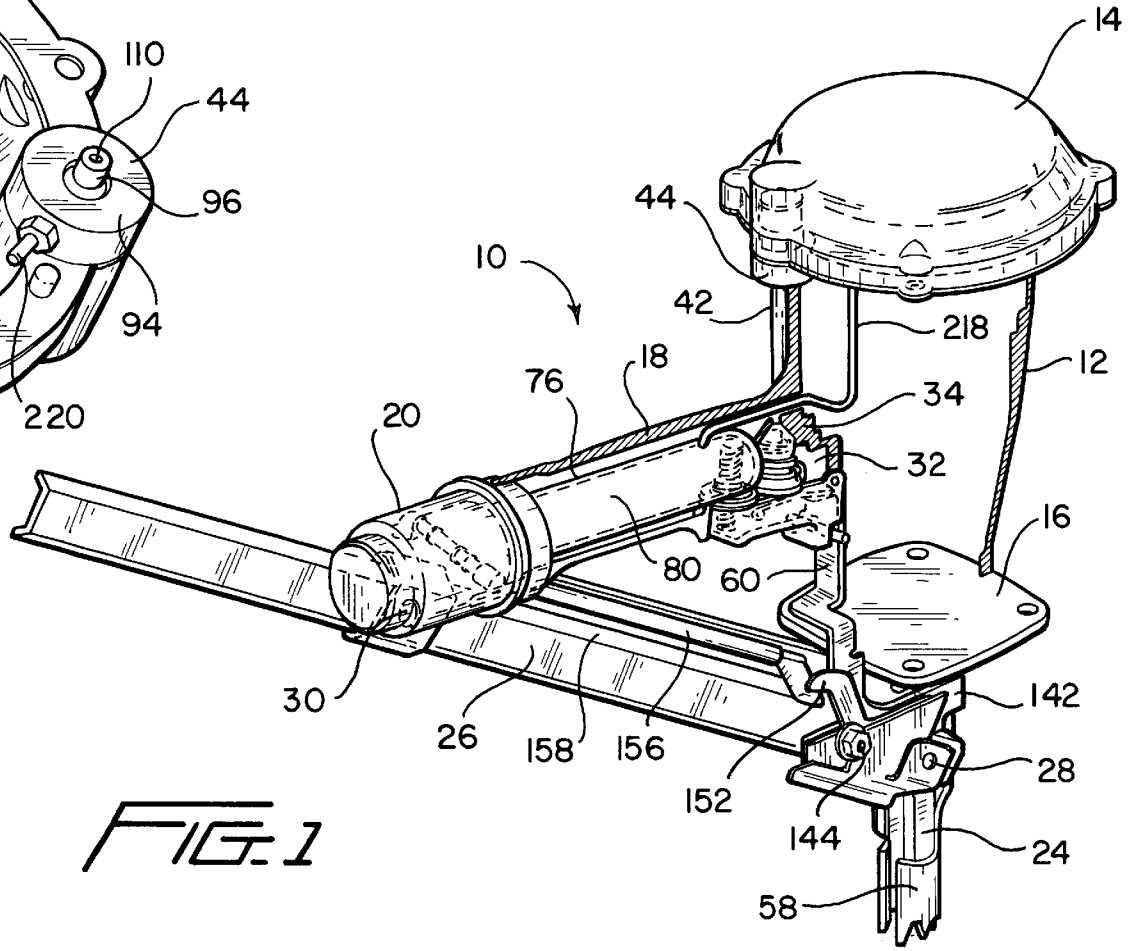
FIG. 1 is a schematic, perspective first side view of a new and improved pneumatic fastener driving tool constructed in accordance with the teachings and principles of the present invention and showing the cooperative parts thereof.
Figure 8:
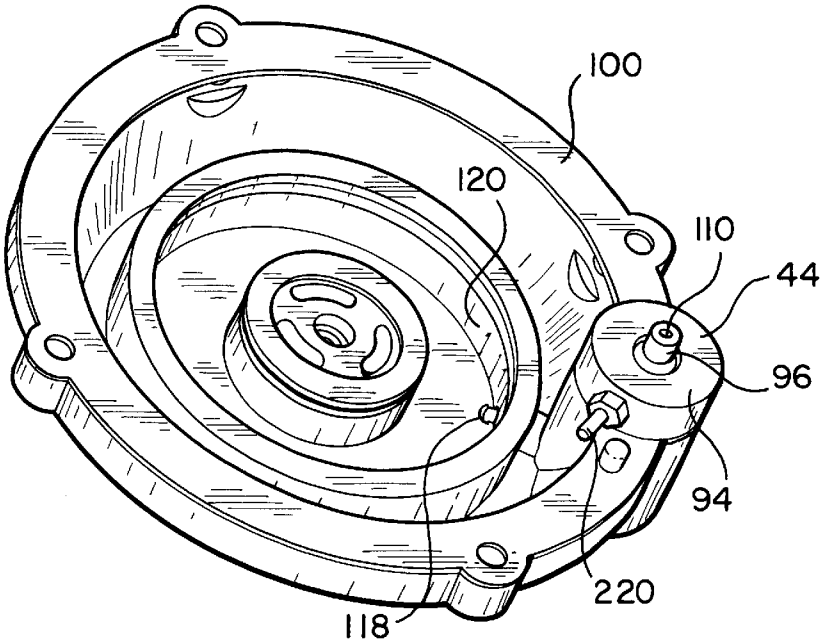
FIG. 8 is a bottom perspective view of the main valve assembly of the new and improved pneumatic fastener driving tool shown in FIG. 1.
Figure 5:
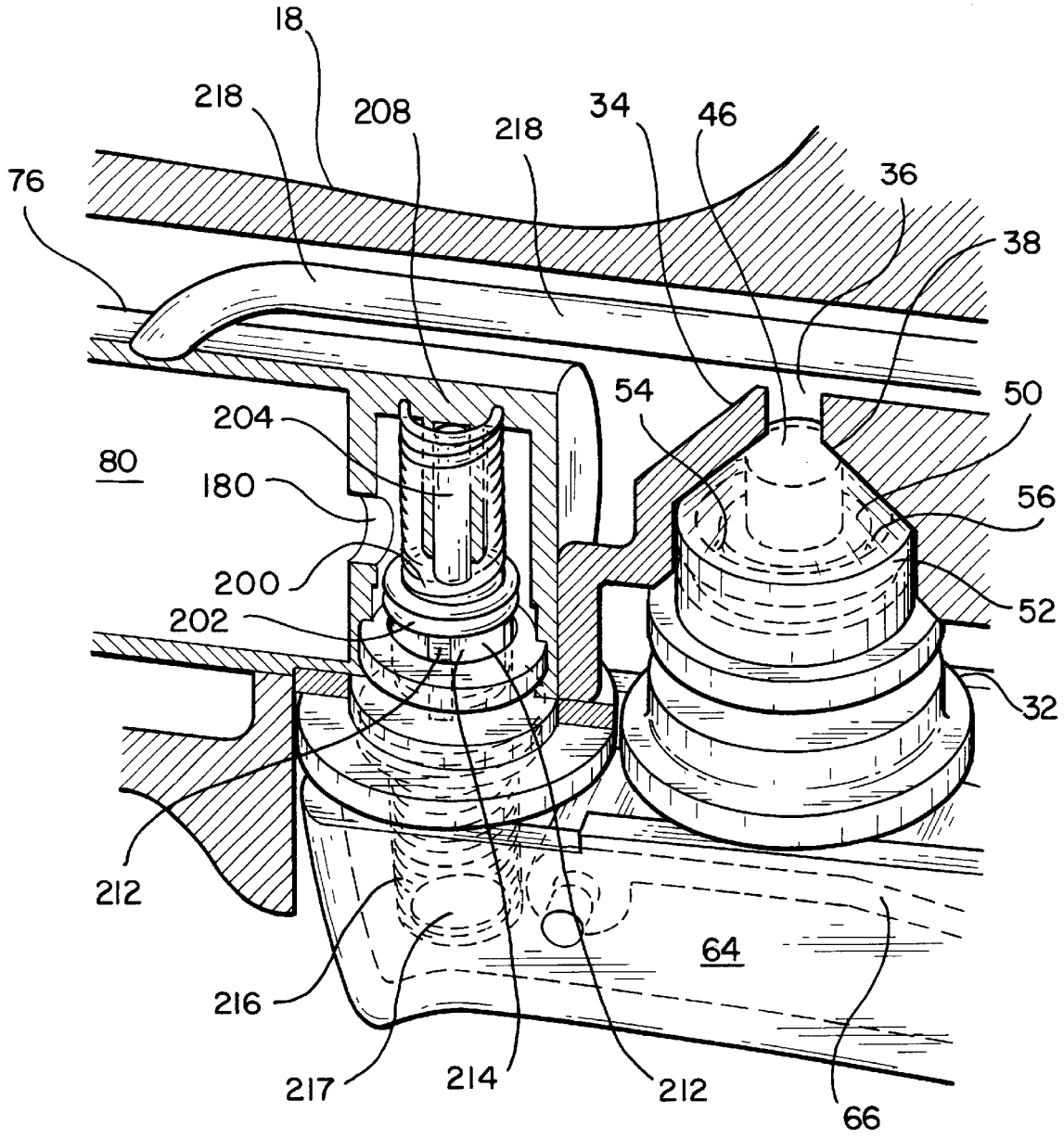
FIG. 5 is a schematic, enlarged perspective view similar to that of FIG. 4 showing, however, the disposition of the trigger, relief valve, and pilot valve components in their relative positions when the trigger element or mechanism is depressed or actuated and when there is little or no pressure present within the reservoir tank whereby the relief valve is unseated so as to fluidically connect the reservoir tank to atmosphere.
Figure 6:
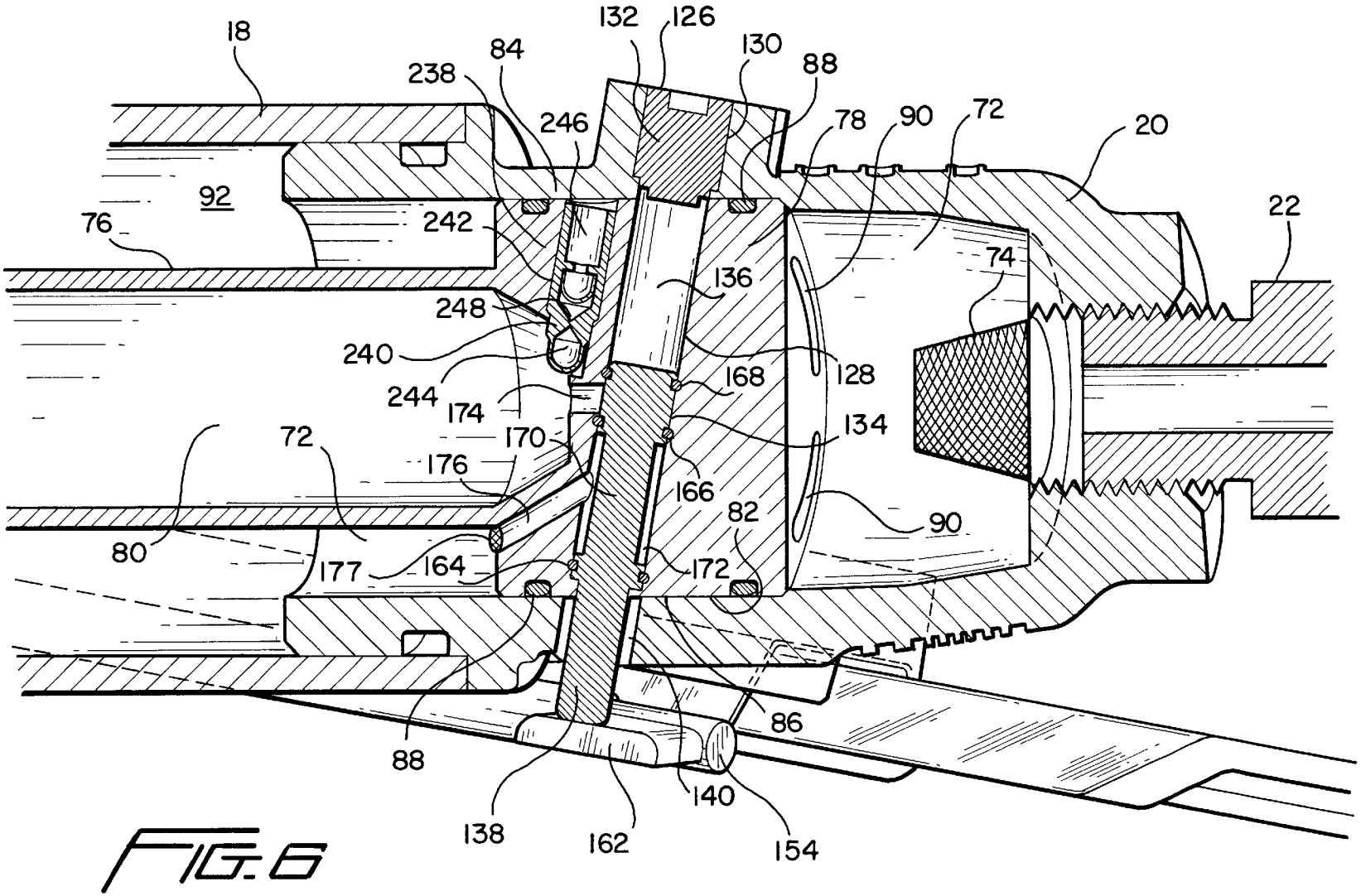
FIG. 6 is a schematic, enlarged cross-sectional view of the end cap, reservoir tank, fill valve, and bleed valve components of the new and improved pneumatic fastener driving tool shown in FIG. 1 and showing the components in their relative positions when the workpiece contact element or mechanism is not engaged or disposed in contact with a workpiece whereby the reservoir tank is not able to be pressurized with compressed line air.
Figure 7:
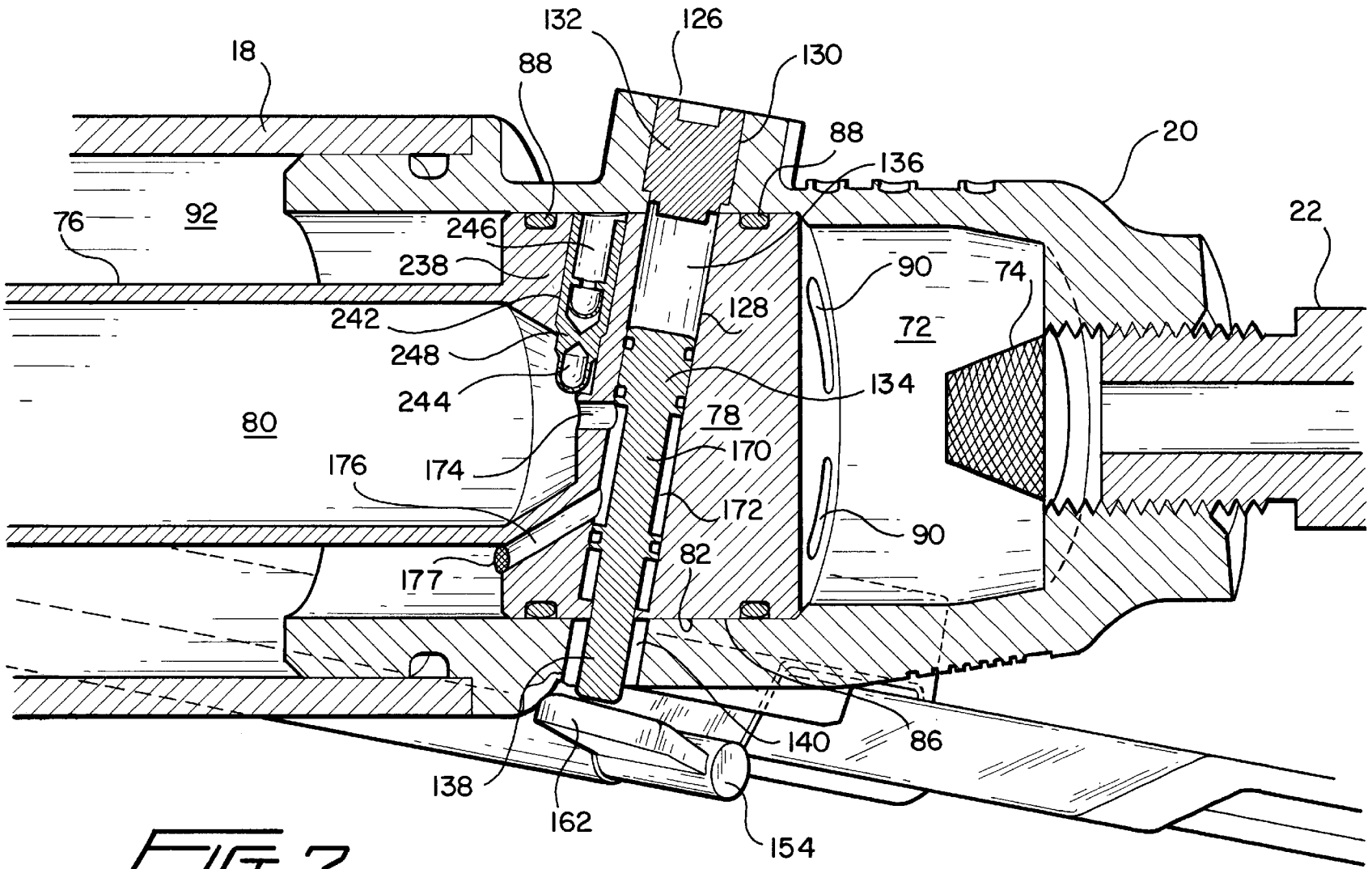
FIG. 7 is a schematic, enlarged side elevational view similar to that of FIG. 6 showing, however, the disposition of the components in their relative positions when the workpiece contact element or mechanism is engaged or disposed in contact with a workpiece whereby the reservoir tank is able to be pressurized with compressed line air.
Figure 12:
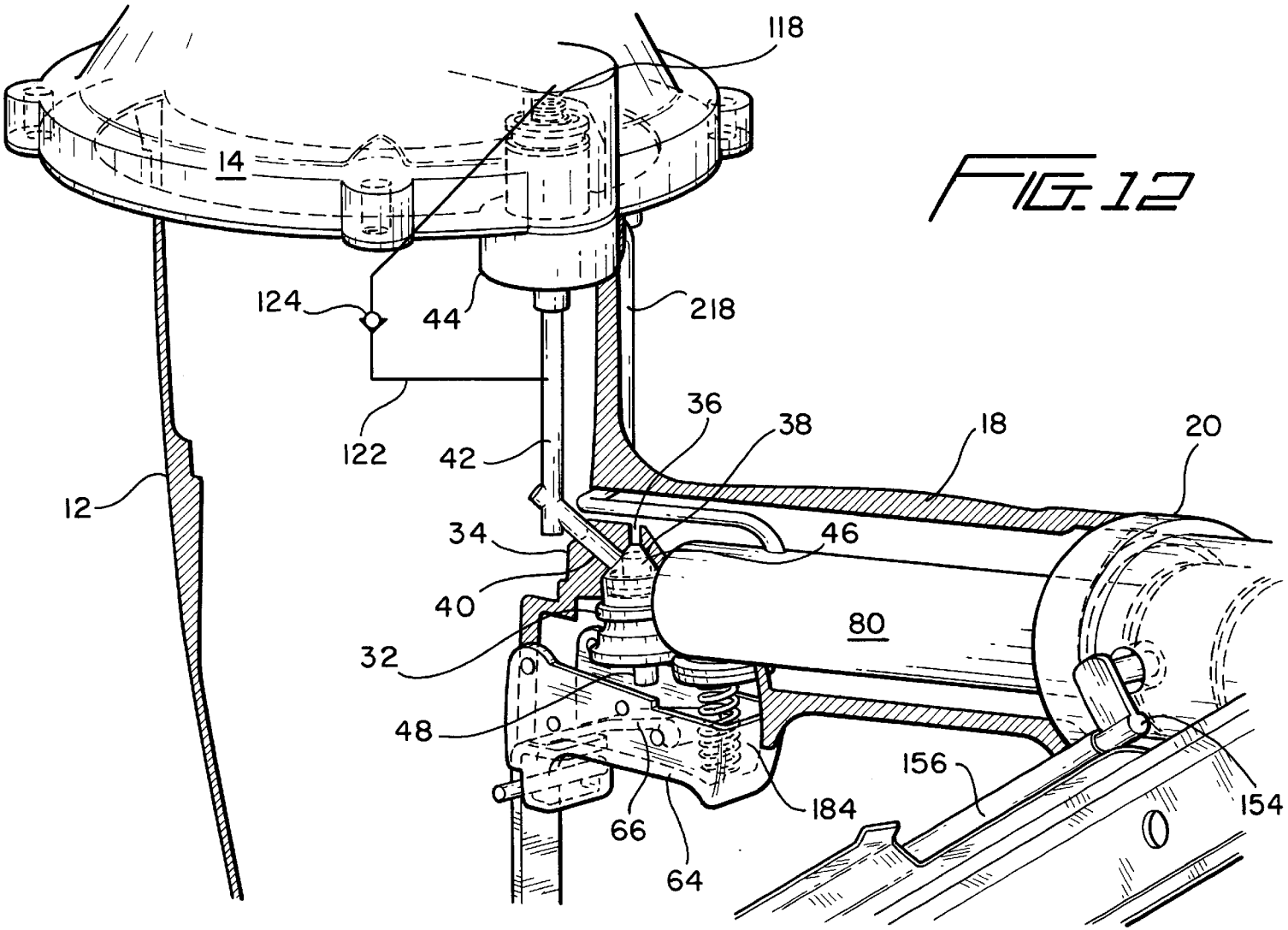
FIG. 12 is a schematic, perspective side view of the new and improved pneumatic fastener driving tool as illustrated in FIG. 1 showing, however, the disposition of the various components of the tool from a second opposite side of the tool and when the workpiece contact element or mechanism is not engaged or disposed in contact with a workpiece.
Figure 13:
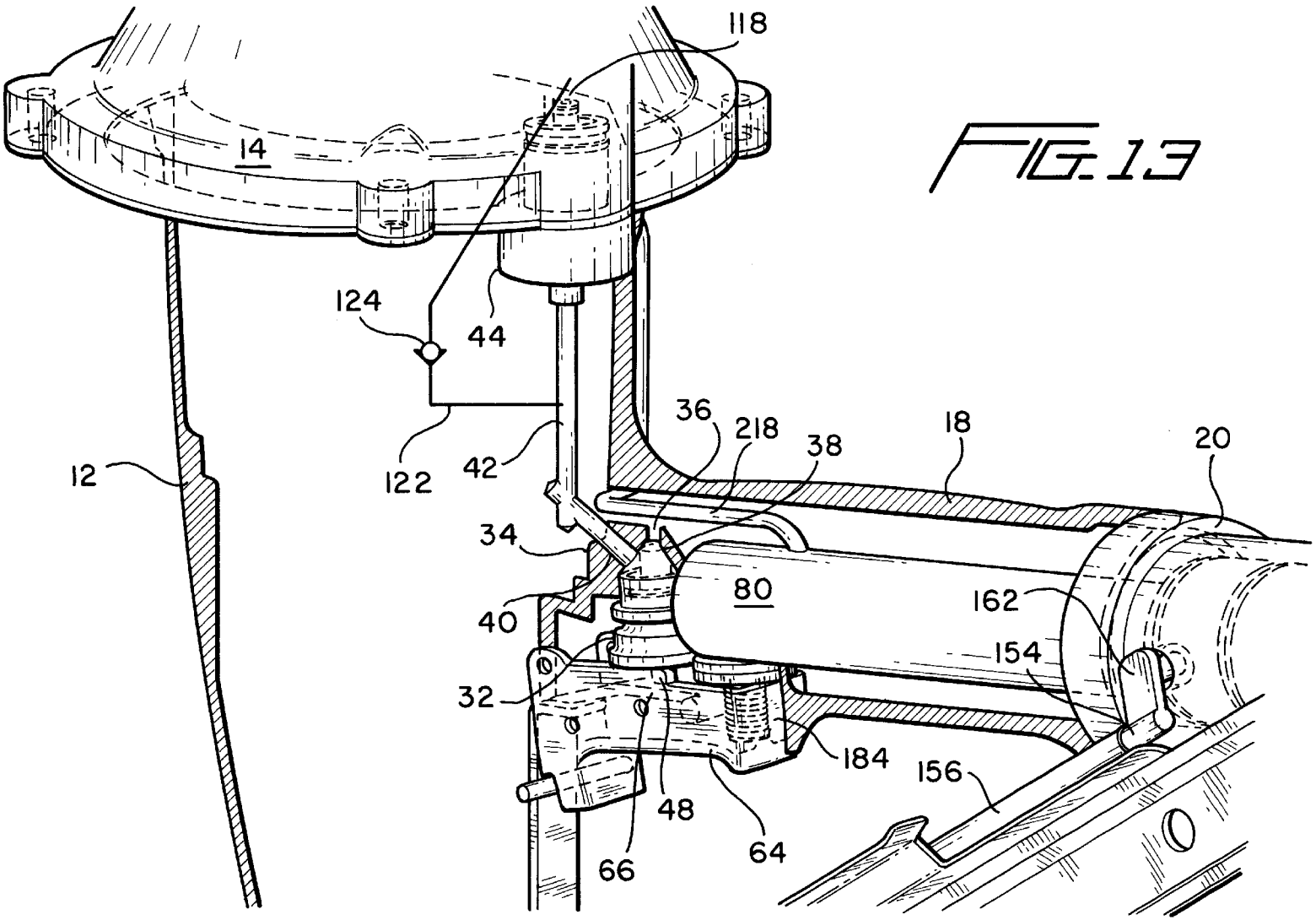
FIG. 13 is a schematic, perspective side view similar to that of FIG. 12 showing, however, the disposition of the various components of the tool when the workpiece contact element or mechanism is engaged or disposed in contact with a workpiece.

Referring now to the drawings, and more particularly to FIG. 1 thereof, the new and improved pneumatic fastener driving tool constructed in accordance with the principles and teachings of the present invention is disclosed and is generally indicated by the reference character 10. The tool 10 is seen to comprise an upstanding or substantially vertically disposed housing 12 which supports a conventional main valve 14 at the upper end thereof and a nose assembly 16 at the lower end thereof. The housing 12 also has a substantially horizontally handle portion 18 integrally formed therewith, and the remote or distal end of the handle portion 18 is provided with an end cap 20 which is adapted to be threadedly mated with a compressed air fitting 22 which is best seen in FIGS. 6 and 7 and by means of which compressed air is supplied into the handle portion 18 of the tool 10. Nose assembly 16 comprises a dependent leg portion 24, and one end of a fastener magazine 26 is adapted to be fixedly mounted upon the leg portion 24 by means of a suitable bolt member as at 28, while an opposite end portion of the fastener magazine 26 is adapted to be fixedly mounted upon the end cap 20 by means of another suitable bolt member as at 30. As is well known in the art, the housing 12 and main valve 14 are initially pressurized or charged through means of a first fluid flow path defined within a pilot valve assembly 32, and when a second fluid flow path defined within the pilot valve assembly 32 is opened while the first fluid flow path is closed, compressed air disposed within the main valve 14 is able to be vented to atmosphere, as will be discussed in detail hereinafter, whereby a fastener is discharged or fired from the magazine 26. More particularly, as can best be appreciated as a result of additional reference being made to FIGS. 2–5, 12, and 13, the pilot valve assembly 32 is disposed within a substantially conically shaped housing portion 34 which is incorporated between the main housing 12 and the handle portion 18. As may best be appreciated from FIGS. 12 and 13, the housing portion 34 is provided with a first upper bore 36 wherein the interior portion of the housing portion 34 which defines the innermost end of the first upper bore 36 defines a first valve seat 38. The housing portion 34 is also provided with a second bore 40 within which a first end of a tubular conduit 42 is disposed such that the first end of the tubular conduit 42 is in fluidic communication with the interior of the housing portion 34.

The opposite or second end of the tubular conduit 42 is fluidically connected to an enable valve assembly 44 which is adapted to be disposed in fluidic communication with the main valve 14. The first upper valve bore 36 and the tubular conduit 42 therefore define the aforenoted first fluid flow path through the pilot valve assembly 32. The pilot valve assembly 32 also comprises an upper valve member 46 which is adapted to be seated upon the first valve seat 38 when the first upper valve bore 36 is adapted to be closed, and a lower valve stem 48 which is in effect integral with the valve member 46. A spring member, not shown, normally biases the valve member 46-valve stem 48 component in the downward direction as viewed in FIG. 12 such that the valve member 46 is normally not seated upon the first valve seat 38 whereby first upper valve bore 36 is normally open. Still further, as can best be appreciated from FIGS. 4 and 5, the valve member 46 has a flange portion 50 integrally formed therewith, and the pilot valve assembly 32 further comprises a body portion 52 which is sealingly engaged with an interior wall section of housing portion 34 and within which there is defined an axially extending bore or passageway 54, as best seen in FIG. 5. The upper end of bore or passageway 54 defines a second valve seat 56 upon which the valve flange portion 50 is adapted to be seated when the pilot valve assembly 32 is disposed in its normal position with valve member 46 unseated with respect to the first valve seat 38. The lower end portion of the axially extending bore or passageway 54 annularly surrounds lower valve stem 48 and is fluidically connected to atmosphere whereby tubular conduit 42 and axial bore or passageway 54 define the aforenoted second fluid flow path through the pilot valve assembly 32 when the main valve 14 is to be vented in connection with the discharge or firing of a fastener from the tool magazine 26.

With reference again being made to FIGS. 1–3, a workpiece contact element 58 is slidably mounted in a known manner upon the dependent leg portion 24 of the nose assembly 16, and the workpiece contact element 58 is fixedly connected to an upwardly extending linkage member 60. The tool 10 further comprises a trigger assembly 62 which includes a substantially reciprocable trigger member 64 and a trigger lever 66 pivotally mounted upon the trigger member 64. An upper end portion 68 of the work contact element linkage member 60 is seen to be disposed in contact with a distal end portion 70 of the trigger lever 66, and accordingly, when the work contact element 58 is depressed against a workpiece, not shown, the work contact element 58 will be moved upwardly from the position shown in FIG. 2 to the position shown in FIG. 3 whereby the trigger lever 66 will be pivoted upwardly so as to now be disposed in contact with the valve stem 48. It is to be noted however that despite the fact that the trigger lever 66 has been moved upwardly and is now disposed in contact with the valve stem 48, the trigger lever 66 at this point in time does not move valve stem 48 upwardly so as to seat valve member 46 upon first valve seat 38 and unseat valve flange portion 50 from second valve seat 56.

Figure 3:
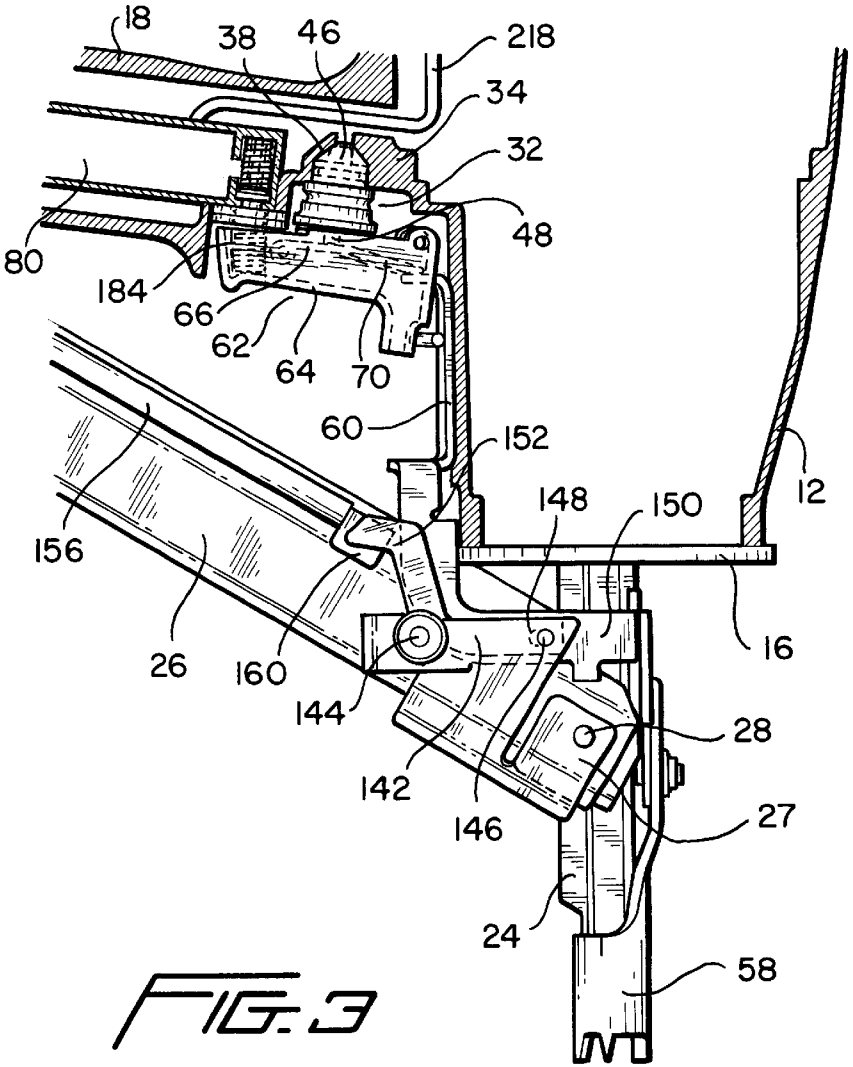
FIG. 3 is a schematic side elevational view similar to that of FIG. 2 showing, however, the workpiece contact element or mechanism disposed in its raised state as a result of engagement or contact with a workpiece.
Figure 2:
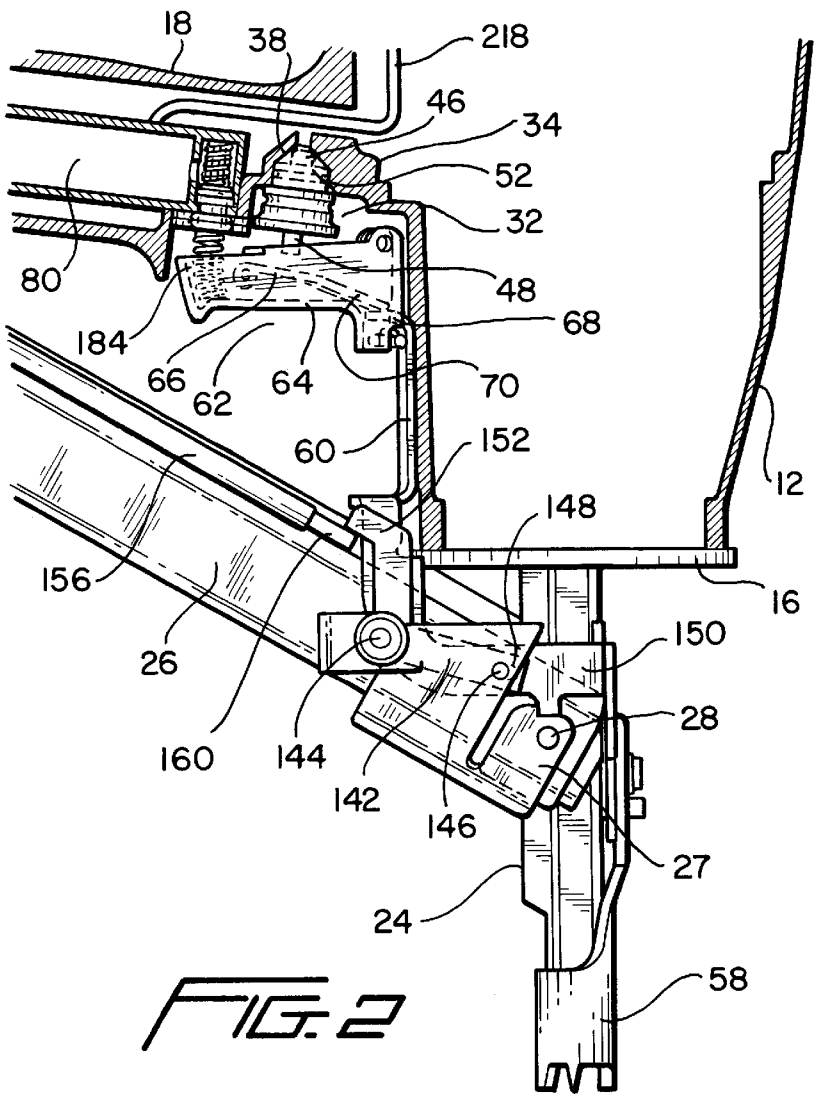
FIG. 2 is a schematic side elevational view of a part of the new and improved pneumatic fastener driving tool illustrated in FIG. 1 and showing the workpiece contact element or mechanism disposed in its normal non-engaged state as well as its associated linkage members operatively connecting the workpiece contact element or mechanism to both the tool trigger element or mechanism and the fill valve shaft.
Figure 4:
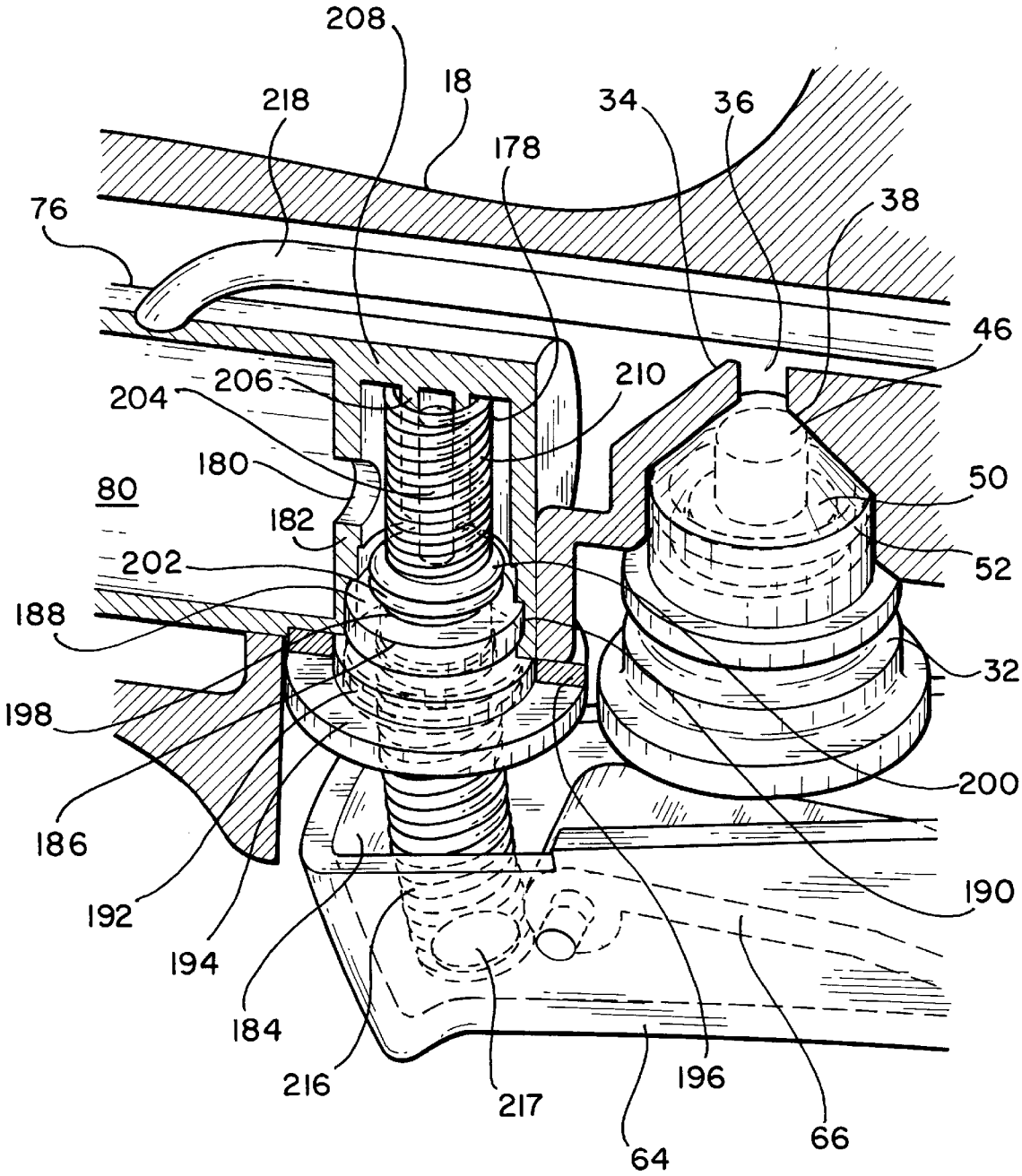
FIG. 4 is a schematic, enlarged perspective view of the trigger, relief valve, and pilot valve components of the new and improved pneumatic fastener driving tool shown in FIG. 1 and showing the components in their relative positions when the trigger element or mechanism is disposed in its released state.

In order to in fact achieve upward movement of the valve stem 48 and concomitant upward movement of integral valve member 46 so as to seat valve member 46 upon first valve seat 38, as well as to unseat valve flange portion 50 with respect to second valve seat 56, trigger member 64 must likewise be moved upwardly from the position shown in FIG. 2 to the position shown in FIG. 3. It is only through means of the combined movements of the workpiece contact element 58, and its operatively connected linkage member 60, and the trigger member 64, that valve stem 48 and valve member 46 are moved upwardly whereby the valve member 46 is able to be seated upon first valve seat 38 as shown in FIG. 3. Either movement of the workpiece contact element 58 or trigger member 64 by themselves in an individual manner will not result in upward movement of the valve stem 48 and valve member 46.

In order to convey the charging or pressurizing air from the compressed air fitting 22 to the pilot valve assembly 32 such that the pilot valve assembly 32 can in turn convey the charging or pressurizing air to the enable valve assembly 44 and the main valve 14 by means of the interior chamber of housing portion 34 and fluid conduit 42, the inner end of the compressed air fitting 22 is disposed within an interior portion or chamber 72 of the end cap 20 as best seen in FIGS. 6 and 7. A first filter member 74 is disposed upon the inner end of the compressed air fitting 22 for filtering the incoming compressed air. A reservoir tank assembly 76 is substantially coaxially disposed within the hollow interior of the tool handle 18, and it is seen that the reservoir tank assembly 76 comprises a block member 78 which is adapted to be disposed within the interior portion or chamber 72 of the end cap 20 while an integrally connected reservoir tank 80 extends from block member 78 toward the main housing 12 of the tool 10. The outer peripheral wall portion 82 of the block member 78 is spaced slightly from the inner peripheral wall portion 84 of the end cap 20, as at 86, for a purpose to be discussed hereinafter, however, in order to in effect render the peripheral interface defined between the outer peripheral wall portion 82 of the block member 78 and the inner peripheral wall portion 84 of the end cap 20 airtight such that air from fitting 22 cannot bypass block member 78 through means of peripheral space 86, block member 78 is provided with a pair of axially spaced O-rings 88. The block member 78, however, is further provided with a plurality of through-slots 90 which therefore permit the incoming compressed air from fitting 22 to be conveyed into the interior portion or chamber 72 disposed upon the opposite side of the block member 78 and into an interior space 92 which is defined within the handle portion 18 and which annularly surrounds the reservoir tank 80. Space 92 of handle portion 18 is in fluidic communication with the interior portion of the housing portion 34 through means of first upper valve bore 36 when the valve member 46 of the pilot valve 32 is unseated with respect to first valve seat 38 whereby the incoming charging or pressurizing air is able to be conveyed through fluid conduit 42 to the enable valve assembly 44 and main valve 14.

With reference now being made to FIGS. 8–13, the structure and operation of the enable valve assembly 44 will be described. The enable valve assembly 44 is seen to comprise a valve housing 94 which is integral with the main housing 12 and within which there is disposed a lower base member 96. The upper end of the fluid conduit 42 is fluidically connected to the lower base member 96, and the lower base member 96 is also fixedly connected to a cylinder 98. The cylinder 98 is mounted within an underside portion of the main valve 14, and a gasket 100 seals the interface defined between the valve housing 94 and the undersurface of the main valve 14. A piston type spool valve 102 is adapted to be reciprocally disposed within the cylinder 98, and accordingly, a spring 104 is coaxially disposed within an axial bore or passage 106 formed within the spool valve 102 with the lower end of the spring 104 engaged in contact with the bottom end of the axial passage or bore 106 so as to normally bias the spool valve 102 downwardly whereby the lower end of the spool valve 102 is seated upon a valve seat 108 formed upon the lower base member 96. A fluid passage 110 is defined within the lower end portion of the base member 96 so as to fluidically connect fluid conduit 42 to the underside of the spool valve 102. A radial passage 112 is defined within a lower end portion of the spool valve 102 such that the radial passage 112 is fluidically connected to the axial passage 106. The upper end of the spring 104 is seated within an upper support member 114, and the upper end portion of the upper support member 114 is provided with an axial passageway or bore 116. A radial passageway or bore 118 is defined within a side wall portion 120 of the main valve 14 and is adapted to be fluidically connected to the axial passageway or bore 116 such that compressed or pressurized air can be supplied or charged into the main valve 14.

Accordingly, when the tool 10 is initially connected to the compressed air fitting 22, compressed air is conveyed from fitting 22 through reservoir tank block member 78 and into the annular handle space portion 92. Since at this point in time neither the workpiece contact element 58 nor the trigger member 64 is depressed, the pilot valve assembly 32 is disposed in the position shown in FIG. 4 whereby the valve member 46 is unseated with respect to the first valve seat 38 and consequently, pressurized air from the fitting 22 is able to be conveyed from the annular handle space portion 92, through first upper valve bore 36 of the pilot valve assembly 32, into fluid conduit 42, and into the enable valve assembly 44 as at 42*a*. The pressurized air 42*a* is in turn conveyed from fluid conduit 42 into axial bore or passage 110 whereby the pressurized air acts upon the lower end portion of the spool valve 102 so as to raise the spool valve 102 from the position shown in FIG. 9 to that shown in FIG. 10, or in other words, unseat the spool valve from its valve seat 108 against the biasing force of spring 104. Accordingly, the compressed air is able to be routed from passageway or bore 110, around the lower end portion of the spool valve 102 and into radial bore 112, upwardly through axial bore 106, into axial passageway or bore 116, and through radial passageway or bore 118 so as to enter into the main valve 14 and thereby pressurize the same.

It has been recognized that the charging or pressurizing of the main valve 14 needs to be accomplished in a rapid manner whereby the main valve 14 can close rapidly and prevent the inadvertent discharge or firing of a fastener from the tool. It has been additionally recognized that the movement of the spool valve 102 initially encounters resistance in that the opening of the spool valve 102 by means of the incoming pressurized air acts against the biasing force of the spring 104. Accordingly, a predetermined restriction to the incoming air flow occurs which is not desirable from the viewpoint of properly implementing the required fluid flows. Therefore, it is additionally recognized that it is desirable to in effect incorporate within the fluid flow path from fluid conduit 42 to passageway or bore 118 an unrestricted or low-restriction flow path, and this is achieved as a result of the provision of an auxiliary or bypass flow path defined by means of a fluid conduit 122 which has a one-way check valve 124 incorporated therein. Accordingly, in addition, in effect, to the primary pressurized fluid flow through the fluid conduit 42 and the enable valve 44, secondary pressurized fluid flow flows from fluid conduit 42 directly into the radial bore or passageway 118 and into the main valve 14 so as to properly pressurize the same and ensure that the main valve 14 is rapidly closed in preparation for a fastener firing cycle.

With reference now being made to FIGS. 1–3, 6, 7, 12, and 13, it is seen that the end cap end of the reservoir tank assembly 76 of the pneumatic fastener driving tool 10 further comprises a fill valve assembly 126. More particularly, the reservoir tank block member 78 is provided with a through-bore 128, and an axially central side wall portion of the end cap 20 is similarly provided with a through-bore 130 within which a spring stop 132 is adapted to be disposed. A spool type fill valve 134 is movably disposed within the block member through-bore 128, and a spring 136 is interposed between the upper end of the fill valve 134 and the spring stop 132 so as to normally bias the fill valve 134 downwardly to the position illustrated in FIG. 6. A lowermost end portion 138 of the fill valve 134 in effect forms an actuator button which projects outwardly through the lower end of the throughbore 128 and also projects through another throughbore 140 formed within a side wall portion of the end cap 20 which is disposed substantially opposite the side wall portion of the end cap 20 within which the spring stop through-bore 130 is defined. In order to actuate the fill valve 134, the linkage member 60 has a lever 142 operatively associated therewith. More particularly, the lever 142 is pivotally mounted upon a bracket 27 of the magazine 26 as at 144, and a first end of the lever 142 is provided with a pin 146 which is disposed within a slot 148 formed within a horizontal portion 150 of the linkage member 60. The second opposite end of the lever 142 is provided with an ear 152. A shaft 154, as best seen in FIGS. 6, 7, 12, and 13, is rotatably mounted within a tubular member 156 which is fixedly mounted upon a cover member 158 of the magazine 26, and a first end of the shaft 154 is provided with a first flag member 160 which is adapted to be engaged with the ear 152 of the lever 142 while a second end of the shaft 154 is provided with a second flag member 162 which is adapted to be engaged with the actuator button 138 of the fill valve 134.

As may thus be appreciated from FIGS. 2 and 3, when the workpiece contact element 58 is moved relatively upwardly as a result of the workpiece contact element 58 being engaged or disposed in contact with a workpiece and the tool 10 being moved downwardly toward the workpiece, linkage member 60 is moved upwardly whereby horizontal portion 150 of linkage member 60 is moved upwardly so as to cause pivotal movement of the lever 142 in the counterclockwise direction. Accordingly, ear 152 of lever 142 causes the shaft 154 to be rotated as a result of the engagement of the ear 152 with the first flag member 160 of shaft 154, and in a similar manner, the rotation of the shaft 154 causes the second flag member 162 to be rotated upwardly from the position shown in FIG. 6 to the position shown in FIG. 7 whereby the second flag member 162 engages the actuator button 138 and moves the fill valve 134 upwardly within the bore 128 against the bias of spring 136.

As may best be appreciated with reference again being made to FIGS. 6 and 7, the fill valve 134 is further provided with a plurality of annular recesses within which a plurality of O-rings 164,166,168 are disposed, and a small diameter portion of the fill valve 134 is formed at 170 such that an annular space 172 is defined between the outer periphery of smaller diameter portion 170 and the inner periphery of bore 128. The reservoir tank block member 78 is also provided an axial bore 174 which fluidically connects reservoir tank 80 to the bore 128, and an inclined bore 176 which likewise fluidically connects the internal annular space 92 of the tool handle 18 and the interior portion or chamber 72 of the end cap 20 with the bore 128. Consequently, it can be appreciated that whenever the workpiece contact element 58 is engaged or disposed in contact with a workpiece and the tool 10 depressed with respect to the workpiece, the aforenoted vertical movement of the workpiece contact element 58, the pivotal movement of the lever 142, and the rotation of shaft 154 will cause the second flag member 162 to engage the actuator button 138 of the fill valve 134 and cause the fill valve 134 to move upwardly against the bias of spring member 136. Accordingly, the fill valve 134 moves from the position shown in FIG. 6 to that shown in FIG. 7 wherein it can be appreciated that the annular space 172 is now able to fluidically interconnect the inclined bore 176 to the axial bore 174 whereby reservoir tank 80 is now able to be charged or pressurized with compressed air from compressed air fitting 22. A second filter member 177 may be disposed upon the entrance of bore 176 so as to prevent contaminants from fouling the fill valve assembly 134 so as to render the same fail-safe in its operation and to ensure the safe operation of the tool.

With reference again being made to FIGS. 1–5, it is seen that the end of the reservoir tank assembly 76 which is disposed opposite the end cap 20 is provided with a chamber 178, and a bore 180 is provided within a partition wall 182, which divides or separates the chamber 178 from the reservoir tank 80, such that the chamber 178 is fluidically connected to the reservoir tank 80. A relief valve assembly 184 is disposed within the chamber 178 and includes a vertically oriented relief valve housing 186. The relief valve housing 186 is provided at its upper end portion with a radially outwardly projecting flange portion 190 which is externally threaded such that the relief valve housing 186 can be threadedly mounted within an internally threaded recessed portion 188 defined within the lower end of the wall structure of reservoir tank assembly 76 which defines chamber 178. The lower end portion of the relief valve housing 186 is also externally threaded as at 192 such that an internally threaded washer 194 can be threadedly mounted thereon. A gasket 196 is adapted to be interposed and secured between the washer 194, a portion of the reservoir tank 80, and a portion of the tool handle 18 when the washer 194 is threadedly tightened upon the lower end portion 192 of the relief valve housing 186. The bottom or lower end portion of the relief valve housing 186 is open to atmosphere, and the top or upper end portion of the relief valve housing 186 is likewise open and forms a valve seat 198 upon which a poppet valve member 200 is adapted to be seated when the relief valve assembly 184 is closed. The poppet valve member 200 has an annular seal member 202 fixedly mounted thereon which is actually adapted to be sealingly mated with the valve seat 198 when the relief valve assembly 184 is closed. The poppet valve member 200 further comprises an upstanding stem portion 204 which is adapted to be coaxially disposed within a hollow cylinder 206 which is integral with and depends downwardly from an upper wall member 208 defining the chamber 178, and a first spring 210 annularly surrounds the cylinder 206 so as to be interposed between the upper wall member 208 of the chamber 178 and the poppet valve member 200 whereby the poppet valve member 200 is normally biased downwardly onto valve seat 198. The underside of the poppet valve member 200 has a pair of intersecting ribs 212 integrally formed therewith and which are disposed at substantially 90° with respect to each other. The ribs 212 in effect form a structure which has a cross-sectional configuration, and which therefore define quadrant-shaped spaces 214 therebetween as best seen in FIG. 5.

A second spring 216 has an upper end portion thereof disposed internally within the washer 194 and the relief valve housing 186 so as to be disposed in contact with the rib members 212 while a lower end portion of the second spring 216 is disposed in contact with an interior surface of the tool trigger 64. The interior surface of the trigger 64 is provided with an upstanding boss or the like 217 around which the lower end of the second spring 216 is seated. In this manner, the second spring 216 is interposed between the underside of the poppet valve member 200 and the trigger 64 such that the second spring 216 tends to bias the poppet valve member 200 upwardly and tend to unseat the same with respect to valve seat 198 against the biasing force of the first spring 210. More particularly, however, the spring forces characteristic of the first and second springs 210, 216 are such that in the absence of the depression or upward movement of the trigger 64, first spring 210 will maintain the poppet valve member 200 seated upon the valve seat 198. However, if the trigger 64 is depressed or moved upwardly in the absence of sufficient air pressure present within reservoir tank 80, and therefore chamber 178 as a result of chamber 178 being in fluidic communication with reservoir tank 80 through means of aperture or bore 180, sufficient force will be impressed upon the second spring 216 to compress the same and also to overcome the biasing force of the first spring 210 whereby the poppet valve member 200 will be unseated with respect to valve seat 198. Alternatively and still further, however, if sufficient air pressure is present within the reservoir tank 80 and chamber 178, then despite the depression or upward movement of the trigger 64 and the compression of second spring 216, the force generated upon the poppet valve 200 by means of the air pressure within the reservoir tank 80 and the chamber 178, as well as the biasing force of the first spring 210, is greater than the forces developed by means of the compressed second spring 216 whereby the poppet valve member 200 remains seated upon the valve seat 198.

Figure 10:
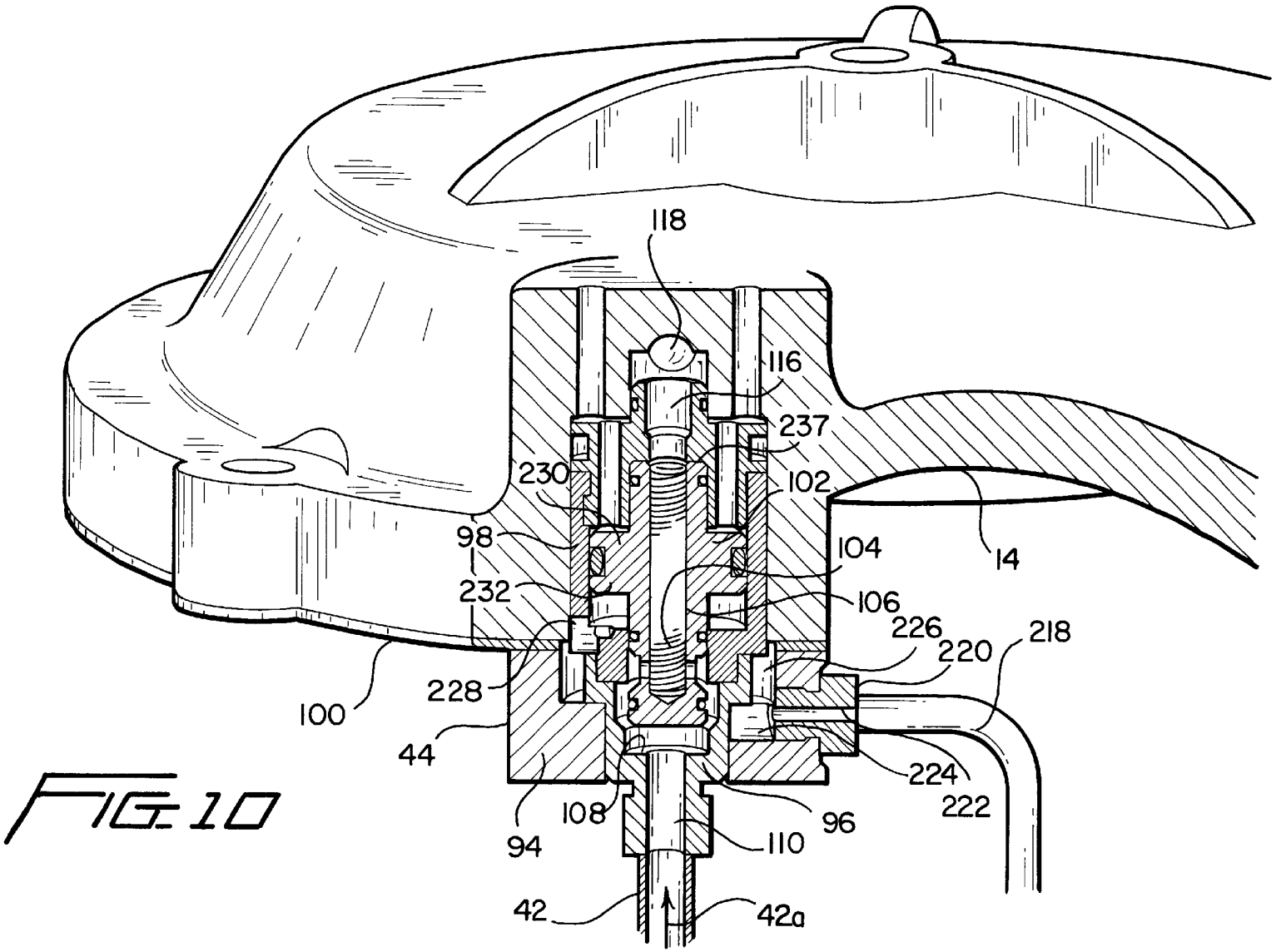
FIG. 10 is a schematic, cross-sectional view similar to that of FIG. 9 showing, however, the component parts of the main valve and enable valve assemblies in their relative positions after the tool has been connected to a compressed air fitting.

It will be recalled that when it is desired to vent the main valve 14 in connection with the discharge or firing of a fastener from the tool magazine 26, compressed air from the main valve 14 is adapted to flow downwardly through the fluid conduit 42 and through the second flow path defined within the pilot valve assembly 32. However, it will also be appreciated that such downward fluid flow through conduit 42 is only able to be achieved as a result of the spool valve 102 being in effect unseated from its valve seat 108. Previously, in connection with the charging or pressurizing of the main valve 14, the aforenoted unseating of the spool valve 102 with respect to its valve seat 108 was achieved by means of the upflowing pressurized air 42*a* as shown in FIG. 10. However, as can further be appreciated, if the fluid conduit 42 is to now conduct fluid flow in the downward direction toward pilot valve 32, an auxiliary or supplemental flow path must be provided within the enable valve assembly 44 so as to simultaneously or concomitantly achieve or maintain the elevation of the spool valve 102 from its valve seat 108 against the biasing force of spring 104 in order to in fact permit the aforenoted downward fluid flow from main valve 14 through fluid conduit 42.

Figure 9:
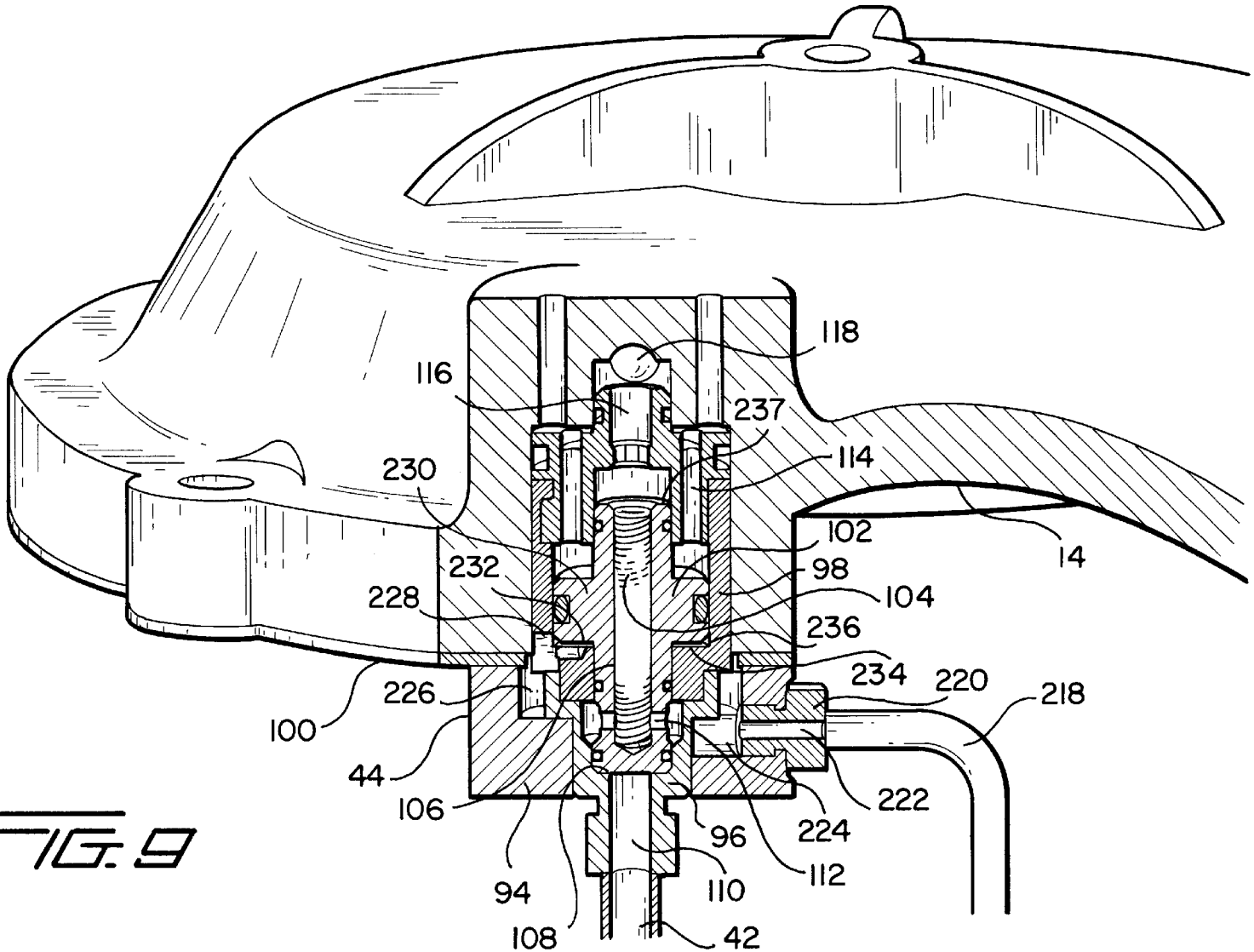
FIG. 9 is a schematic, cross-sectional view of the main valve and enable valve assemblies of the new and improved pneumatic fastener driving tool shown in FIG. 1 showing the operative component parts thereof prior to connection of the tool to a compressed air line fitting.
Figure 11:
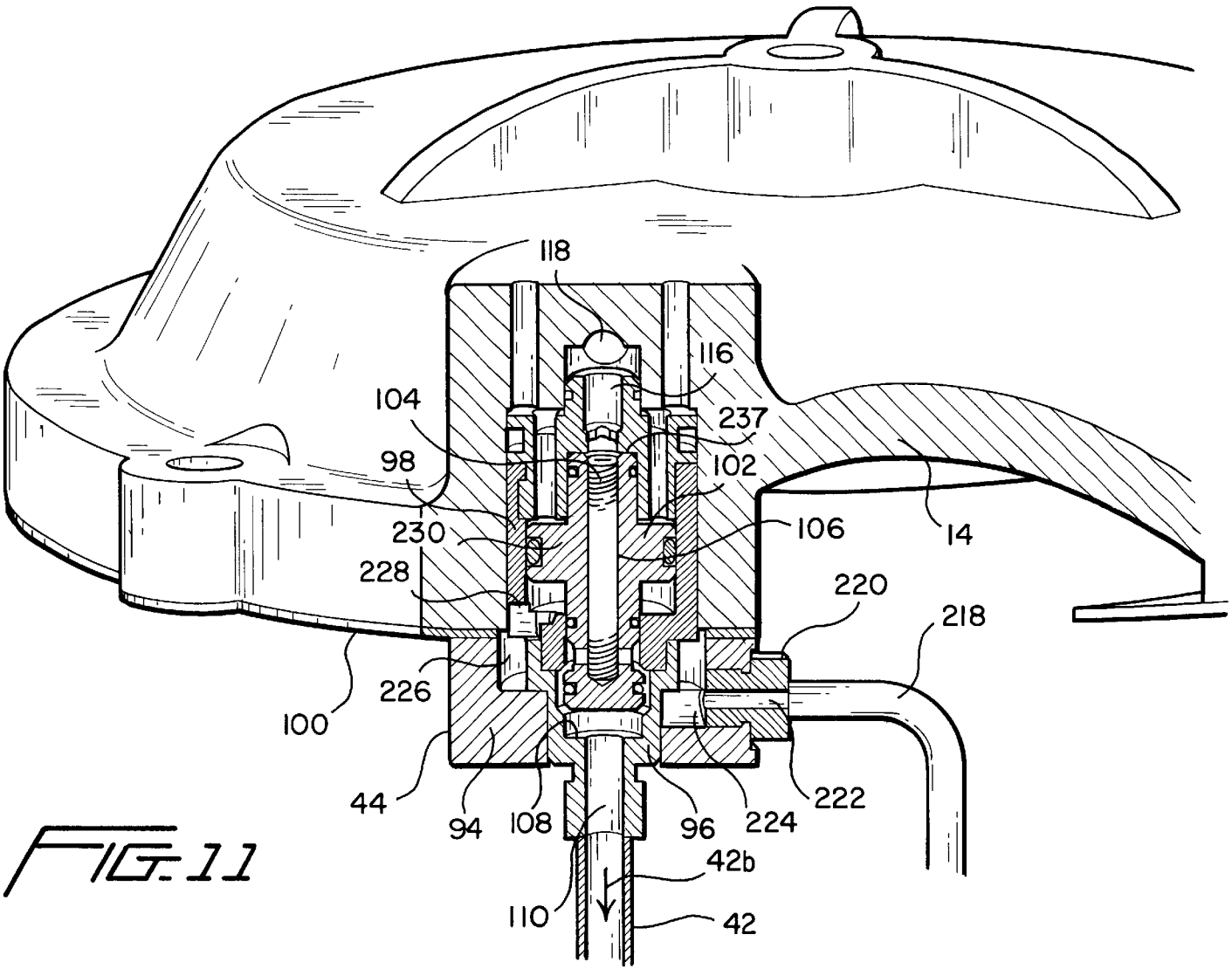
FIG. 11 is a schematic, cross-sectional view similar to that of FIGS. 9 and 10 showing, however, the component parts of the main valve and enable valve assemblies in their relative positions after the reservoir tank of the tool has been pressurized.

Accordingly, as can be seen in FIGS. 1–5, the relief valve assembly end of the reservoir tank 80 has a first end of an air signal line conduit 218 fluidically connected thereto, and as best seen in FIGS. 9–11, the opposite or second end of the air signal line conduit 218 is fluidically connected to the valve housing 94 of the enable valve assembly 44 by means of a fitting 220. Fitting 220 is provided with an axial passageway 222, and the interior of the valve housing 94 is provided with a substantially axial passageway 224 which is immediately in fluidic communication with an annular space 226. Cylinder 98 is also provided with a radial passage 228 which is able to fluidically communicate with the annular space 226. It is also seen that the spool valve 102 comprises a substantially axially central, large diameter portion 230, and in addition, as can be especially appreciated from FIG. 9, it is seen that the annular underside or undersurface 232 of large diameter spool portion 230 is spaced above a radially inwardly extending annular surface portion 234 of the cylinder 98.

Accordingly, pressurized fluid from radial aperture or bore 228 is able to enter an annular space 236 defined between the annular underside or undersurface portion 232 of the spool valve 102 and the annular surface portion 234 of the cylinder 98 such that the pressurized air acts upon the underside or undersurface portion 232 of the spool valve 102 and thereby maintains the spool valve 102 elevated with respect to its valve seat 108 and against any force acting downwardly thereon as a result of air pressure within passageways 118,116 acting upon the diametrically smaller upper portion 237 of the spool valve 102 as well as the biasing force of spring 104. As a result of such structure, when sufficient air pressure is charged or conducted into reservoir tank 80 as a result of the engagement or contact of the workpiece contact element 58 with a workpiece in preparation for the discharge or firing of a fastener from the tool magazine 26, and the consequent movement or actuation of the reservoir tank fill valve 134 through means of the actuation button 138 by second flag member 162, pressurized signal air from reservoir tank 80 can be conducted along signal line conduit 218 to the enable valve assembly 44 so as to actuate the spool valve 102 or maintain the spool valve 102 elevated against the biasing force of spring 104. Accordingly, when the main valve 14 is to be subsequently vented to atmosphere when a fastener is to be discharged or fired from the tool 10 as a result of the operation of the tool trigger 64, since both the workpiece contact element 58 and the tool trigger 64 have been depressed or actuated, trigger lever 66 is moved upwardly so as to in turn actuate the pilot valve assembly valve stem 48 whereby the valve member 46 is now seated upon valve seat 38 so as to close the aforenoted first fluid flow path through pilot valve assembly 32. At the same time, flange portion 50 is unseated from valve seat 56 whereby fluid passageway 54 is now opened. Therefore, pressurized air from main valve 14 can now flow through passageway 118, downwardly through passageways or bores 116,106, into radial bore 112, through axial bore or passageway 110, and into fluid conduit 42 as at 42*b* as seen in FIG. 11 for transmission through the second fluid flow path through pilot valve assembly 39 so as to vented to atmosphere.

Having described substantially all of the various structural components comprising the new and improved pneumatic fastener driving tool 10 constructed in accordance with the principles and teachings of the present invention, the various operative and inoperative modes of the new and improved pneumatic fastener driving tool 10 will now be described. It is initially noted that since the operative mode of the tool 10 comprising the charging or pressurization of the main valve 14, when the tool 10 has initially been fluidically connected to a source of compressed air by means of compressed air fitting 22, has already been described and discussed, further discussion of such mode of operation is hereby omitted so as to prevent redundancy. Accordingly, it is therefore now assumed that a fastener disposed within the tool magazine 26 is desired to be discharged or fired from the tool 10. Remembering that the reservoir tank 80 is only sufficiently charged or pressurized with air as a result of the engagement or contact of the workpiece contact element 58 with a workpiece whereby the fill valve 134 is moved by means of actuator button 138 so as to fluidically connect interior handle space 92 and end cap chamber 72 with the reservoir tank 80 through means of bores 176,174 formed within the reservoir tank block member 78 as well as annular bore 172 formed within the fill valve 134, if the tool trigger 64 is depressed or actuated prior to the contact or depression engagement of the workpiece contact element 58 with a workpiece, then insufficient pressure will be present within the reservoir tank 80 and it will not be possible to fire or discharge a fastener from the tool for a combination of reasons.

Firstly, without sufficient pressure present within the reservoir tank 80, depression or actuation of the tool trigger 64 compresses second spring 216 whereby the force of second spring 216 overcomes the force of first spring 210 so that poppet valve 200 and its associated seal member 202 are unseated from the valve seat 198. Accordingly, when the workpiece contact element 58 is subsequently engaged with the workpiece so as to charge or pressurize the reservoir tank 80, the compressed air immediately escapes or is vented from reservoir tank 80 through means of relief valve assembly 184 as a result of the passage of the air around poppet valve 200 and seal member 202, valve seat 198, and within the spaces 214 defined between the intersecting ribs 212. In addition, and secondly, in view of the absence of sufficient pressure within reservoir tank 80, no air pressure signal, or an insufficient air signal, is able to be transmitted from reservoir tank 80 to the enable valve assembly 44 through means of air signal line 218 so as to maintain enable valve assembly 44 open so as to be capable of transmitting air flow 42*b* which permits venting of the main valve 14. In particular, when a fastener is to be fired or discharged, workpiece contact element 58 is also depressed and pilot valve member 46 is raised so as to close the first fluid path through the pilot valve assembly 32 from the compressed air fitting 22 to the enable valve assembly 44. Accordingly, without the air signal along air signal line 218, spool valve 102 cannot be maintained elevated with respect to its valve seat 108 against the biasing force of spring 104 and therefore main valve 14 cannot be vented so as to fire or discharge a fastener.

As may readily be appreciated, in a similar but reverse manner, considered from the viewpoint of sequentially actuating or depressing the workpiece contact element 58 prior to actuation or depression of the tool trigger 64, a fastener is in fact able to be discharged or fired from the pneumatic fastener driving tool 10. More particularly, but briefly, if the workpiece contact element 58 is initially engaged with a workpiece and depressed or actuated, then pressurized air is supplied into the reservoir tank 80 as a result of the actuation of the fill valve 134. Then when the tool trigger 64 is depressed while the workpiece contact element 58 is maintained in contact with the workpiece, the air pressure within reservoir tank 80 is conveyed into chamber 178 through means of aperture or bore 180 such that the relief valve assembly 184 is maintained closed. In addition, compressed air is supplied to the enable valve assembly 44 through means of air signal line 218. Still further, in view of the upward movement of the trigger lever 66 and the actuation of the pilot valve assembly valve stem 48 and valve member 46 as a result of the combined movements of the workpiece contact element 58 and the tool trigger 64, valve member 46 is seated upon first valve seat 38 so as to close valve bore 36, and valve flange 50 is unseated with respect to second valve seat 56 so as to open bore or passageway 54. As a result of such movements of the various component parts of the tool 10, the main valve 14 is permitted to be vented to atmosphere whereby a fastener is able to be discharged or fired from the pneumatic fastener driving tool 10.

Once the tool 10 has been properly enabled so as to be capable of firing or discharging fasteners, the tool 10 can be used to continuously fire or discharge fasteners in either one of the two known and desired rapid-fire modes of operation, that is, either in accordance with "bump-firing" techniques or "trigger-firing" techniques. As is well known, in accordance with a bump-fire mode of operation, the tool trigger member 64 is maintained depressed or actuated, and each time the workpiece contact element 58 is moved or depressed against a particular area or location of a workpiece at which a fastener is desired to be installed, a fastener is fired or discharged. This is because as a result of the initial enablement of the tool 10, sufficient pressure is already present within the reservoir tank 80, and each time that the workpiece contact element 58 is disposed in contact or engaged with a workpiece, the fill valve 134 is actuated so as to introduce additional air into the reservoir tank 80 and the combined movements of the tool trigger member 64 and the workpiece contact element 58 cause the pilot valve assembly 32 to be properly actuated so as to open the second fluid flow path therethrough thereby enabling venting of the main valve 14. In a similar manner, as is also well-known, in accordance with a trigger-fire mode of operation, the workpiece contact element 58 is maintained depressed or actuated as a result of being maintained in contact with a workpiece, the tool 10 is in effect moved from workpiece location to workpiece location without disengaging the workpiece contact element 58 from the workpiece, and each time the tool trigger member 64 is moved or depressed, a fastener is fired or discharged. This is because as a result of the initial enablement of the tool 10, and maintenance of the workpiece contact element 58 in its actuated or depressed state, sufficient pressure is already and always present within the reservoir tank 80 whereupon depression or actuation of the tool trigger member 64, the combined movements of the tool trigger member 64 and the workpiece contact element cause the pilot valve assembly 32 to again be properly actuated so as to open the second fluid flow path therethrough thereby enabling venting of the main valve 14.

In accordance with a unique and novel feature of the present invention, however, and in order to render the tool 10 safe when, for example, the tool 10 is being transported by operator personnel between job site or work site locations after the tool 10 has been fired or discharged in accordance with either one of the aforenoted modes of operation, and even if the tool trigger member 64 is maintained depressed or actuated, the tool 10 will in effect be disabled whereupon in order to again enable the tool 10, the aforenoted initial sequential operation of the tool 10, wherein the workpiece contact element 58 must be engaged or disposed in contact with a workpiece prior to depression or actuation of the tool trigger 64, must be conducted. Subsequently, after such initial sequential operation of the tool 10, the tool 10 can again be operated in accordance with either one of the aforenoted rapid-fire modes of operation.

More particularly then, in order to achieve the aforenoted safe operation or transport of the tool 10 between job sites or work sites, reference is again made to either one of FIGS. 6 and 7 wherein it is seen that the reservoir tank 80 has operatively associated therewith a bleed orifice valve assembly 238 wherein a bleed orifice valve housing 240 is mounted within a bore 242 defined within the reservoir tank block member 78. A lower bore defined within the housing 240 is provided with a third filter member 244, an upper bore 246 is fluidically connected to the annular space 86 defined between the block member 78 and the interior peripheral wall surface 84 of the end cap 20, and a venturi-type restriction 248 is defined between the upper and lower bores. Accordingly, air pressure from reservoir tank 80 is being constantly bled at a defined or predetermined rate through the bleed orifice valve assembly 238 so as to be vented to atmosphere through means of end cap passage 140 which is disposed in fluidic communication with the annular space 86. Consequently, during either one of the aforenoted rapid-fire modes of operation of the tool 10, if the workpiece contact element 58 is depressed or actuated as a result of engagement with a workpiece within a predetermined amount of time, sufficient air pressure is always generated or maintained within the reservoir tank 80 whereby the tool 10 can be maintained operative in either one of the rapid-fire modes. For example, in accordance with the trigger-fire mode of operation of the tool 10, since the workpiece contact element 58 is always maintained in contact with the workpiece, sufficient pressure is always maintained within the reservoir tank 80. It is to be noted that the third filter 244, similar to the operation of the second filter 177 in preventing fouling of the fill valve assembly 134, prevents fouling of the venturi 248, and in turn, second filter 177 also prevents fouling of the third filter 244 and therefore ensures operation of the tool in a fail-safe mode. The reason for this is that if the second filter 177 fouls, the reservoir tank 80 will not fill with pressurized air and the enable valve assembly 44 will not be enabled or actuated. The second filter 177 also prevents the fill valve assembly 134 from becoming stuck in its upper or raised position whereby pressurized reservoir air would disadvantageously be permitted to enter the reservoir tank 80 without the necessity of the workpiece contact element 58 being disposed in contact or engagement with a workpiece.

In accordance with the bump-fire mode of operation of the tool 10, if the workpiece contact element 58 is engaged with a workpiece within a predetermined amount of time, an insufficient amount of air from reservoir tank 80 has had a chance to be bled before the air pressure within the reservoir tank 80 is again re-established or regenerated, and the tool 10 remains operative. However, if the workpiece contact element 58 is not in fact engaged or disposed in contact with a workpiece within a predetermined amount of time, such as, for example, 1–4 seconds, as would be the case when it is not desired to again fire or discharge the tool 10 and the tool 10 is being transported between job sites or work sites, then a sufficient amount of air is in fact permitted to bleed from the reservoir tank 80, the pressure within the reservoir tank 80 is now insufficient to maintain the relief valve assembly 184 closed as well as to maintain the enable valve assembly 44 open through means of air signal line 218, and operation of the tool 10 is terminated, that is, the tool 10 is disabled. At this point in time, the only way to again enable the tool 10 or to render the same operative is to operate the same in the aforenoted initial sequential mode of operation, that is, the trigger member 64 must be released, the workpiece contact element 58 must be engaged or disposed in contact with a workpiece so as to pressurize the reservoir tank 80, and subsequently, the trigger member 64 may then be depressed or actuated.

Figure 14:
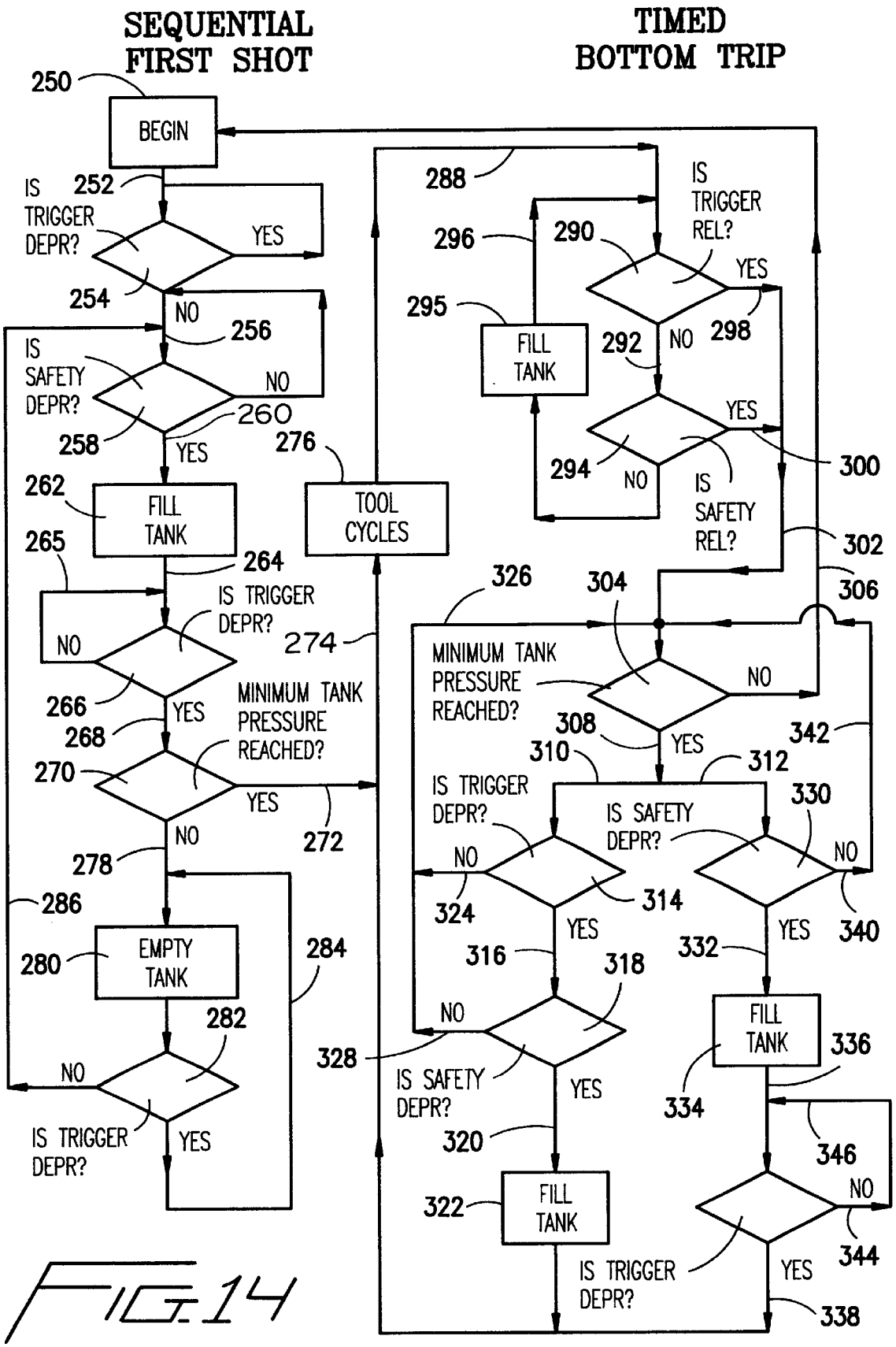
FIG. 14 is a flow diagram summarizing the various modes of operation of the new and improved pneumatic fastener driving tool of the present invention.

The aforenoted modes of operation of the new and improved pneumatic fastener driving tool 10 of the present invention can also be appreciated from the logic flow chart diagram illustrated in FIG. 14 which in effect summarizes the aforenoted modes of operation. More particularly, it is seen that when an operator is to first use the tool 10, the mode of operation commences at block 250 entitled BEGIN. The operation in effect then continues along line 252 wherein the operation would encounter the question contained within the block 254 entitled IS TRIGGER DEPRESSED? If the answer is YES, that is, the trigger is depressed, then in effect the operator must return to line 252 or in effect, begin again, because as known from the foregoing description, the tool 10 cannot be initially enabled if the trigger member 64 is depressed before the workpiece contact element 58 is depressed. If the answer is NO, that is, the trigger member 64 is not depressed, then the operation proceeds along line 256 whereupon the next step of the operation is encountered at block 258.

At block 258, the question IS SAFETY DEPRESSED? is posed. If the answer is NO, that is, if workpiece contact element 58 is not depressed, then the tool 10 obviously cannot be enabled because both the work contact element 58 and the trigger member 64 are not depressed and the operator must in effect return to line 256 and again ask himself if the workpiece contact element 58 is depressed. If the answer is YES, then the operation of the tool 10 continues along line 260 and the reservoir tank 80 is charged or pressurized as denoted by block 262 entitled FILL TANK. The tool operation then proceeds along line 264 whereupon block 266 entitled IS TRIGGER DEPRESSED? is encountered. If the answer is NO, then obviously the tool 10 cannot be fired or discharged and the operator must in effect return to line 264 per flow line 265 and again query if the trigger member 64 is depressed. If the answer is YES, then the operation of the tool 10 proceeds along line 268 whereupon block 270 entitled MINIMUM TANK PRESSURE REACHED? is encountered. If the answer is YES, which would be in accordance with the normal operation of the tool 10, then the tool 10 fires or discharges an initial fastener, and the tool 10 is then ready to enter either one of the rapid-fire modes of operations as schematically illustrated along lines 272 and 274 which brings the tool 10 to box 276 entitled TOOL CYCLES. Reverting back to the point of the operation wherein the question is posed MINIMUM TANK PRESSURE REACHED? as at box 270, if the answer is NO as at 278, then obviously the tool 10 cannot be fired because as previously discussed, without sufficient pressure within reservoir tank 80, relief valve assembly 184 is opened, and an insufficient or no air signal is also not able to be transmitted along air line 218. In view of the open state of the relief valve assembly 184, the reservoir tank 80 is essentially emptied as at the block 280 entitled EMPTY TANK, and if the trigger member 64 continues to be depressed as at block 282 entitled IS TRIGGER DEPRESSED? whereby relief valve assembly 184 will be maintained in its open state, then the tool operation continues along line 284 with the reservoir tank 80 continuing to be emptied. If the trigger member 64 is no longer depressed in response to the question posed at block 282, then the operation of the tool 10 in effect returns along line 286 to line 256 whereby the workpiece contact element 58 can again be depressed as at 258, 260 such that proper or minimum tank pressure can in fact be attained or generated within the reservoir tank 80.

It is to be noted that once the workpiece contact element 58 and the trigger member 64 are properly sequentially depressed as at 260 and 268 whereby reservoir tank 80 should be properly pressurized, the operation of the tool 10 will most likely proceed along line 272 to the TOOL CYCLES 276. The only manner in which the reservoir tank 80 could not be properly pressurized as at 270,278 following the proper sequential operation of the workpiece contact element 58 and the trigger member 64 would be, for example, if the reservoir tank 80 experienced an unknown leak, or alternatively, if somehow the operator was able to depress the trigger member 64 so quickly after depression of the workpiece contact element 58 that an insufficient amount of time passed so as to enable proper pressurization of the reservoir tank 80. It is submitted, however, that the secondly noted operational scenario is most unlikely to occur and would be extremely difficult for an operator to achieve. Nevertheless, if such second scenario did occur, the operator need only release the trigger member 64 such that the operation of the tool 10 proceeds along line 286 and returns the tool operation to the line 256, again depress the workpiece contact element 58 as at 258,260 without depressing the trigger member 64 so as to ensure proper pressurization of the reservoir tank 80, and subsequently depress the trigger member as at 266,268. Once the tool 10 has been operated within its ini-tial cycle or first shot, the tool 10 can then be operated in either one of the aforenoted rapid-fire cycles or modes of operation which commence at box 276 entitled TOOL CYCLES. It is to be remembered that at this point in time, sufficient pressure is present within reservoir tank 80, a fastener has just been discharged or fired, and the tool 10 is capable of being operated in either one of its rapid-fire modes of operation.

Accordingly, when it is desired to fire or discharge another fastener from the tool 10, the operation of the tool 10 proceeds to the TOOL CYCLES step 276 and along the line 288 to the block 290 entitled IS TRIGGER RELEASED? If the answer is NO, then the procedure proceeds along line 292 to the block 294 entitled IS SAFETY RELEASED? If the answer is NO, then the tool 10 is in effect locked or stalled because if both the trigger member 64 and the workpiece contact element 58 remain depressed, the combined depression or actuation movements of the trigger member 64 and the workpiece contact element 58 maintain the valve stem 48 and the valve member 46 in their elevated positions wherein valve member 46 is seated upon valve seat 38 thereby preventing charging or pressurizing of the main valve 14 for the next fastener firing or discharge cycle. The reservoir tank 80 is pressurized, as indicated by block 295 entitled FILL TANK and cycle line 296 because the workpiece contact element 58 is depressed against a workpiece, however, the tool 10 can no longer operatively cycle due to the aforenoted stalled or locked state. If, on the other hand, either one of the trigger member 64 or the workpiece contact element 58 is released as at 298 or 300, respectively, then the operative cycle of the tool 10 can proceed along line 302 because then the tool 10 is no longer stalled or locked in view of the fact that the valve stem 48 and the valve member 46 are not maintained at their raised positions. Accordingly, the main valve 14 can again be charged or pressurized in preparation for a new fastener discharge or firing cycle or operation.

When the tool 10 is then readied for a new fastener firing or discharge cycle or operation, the tool 10 can be operated in accordance with either one of the aforenoted rapid-fire modes of operation, that is, either a bump-fire mode of operation or a trigger-fire mode of operation. In either case, the next and all subsequent rapid-fire fastener discharge or firing cycles must be performed within the aforenoted predetermined time period which preserves sufficient air pressure within the reservoir tank, that is, within a time period of 1–4 seconds. Otherwise, air pressure within the reservoir tank 80 will escape through the bleed orifice 248 whereby sufficient air pressure within the reservoir tank 80 will be lost. This is the question posed at block 304 entitled MINIMUM TANK PRESSURE REACHED?

Accordingly, if the answer to the question is NO, then the tool 10 must be completely recycled as denoted by flow line 306 whereby initialization of the tool operative cycles must begin anew as at block 250 entitled BEGIN. On the other hand, if the next or subsequent operative cycle of the tool 10 is commenced within the aforenoted prescribed time period of, for example, 1–4 seconds, the answer to the question posed at block 304 is YES and operation of the tool 10 proceeds along the flow line 308 and either one of the flow lines 310 or 312. Proceeding along flow line 310 causes operation of the tool 10 in accordance with bump-firing techniques, whereas proceeding along flow line 312 causes operation of the tool 10 in accordance with trigger-firing techniques. More particularly, if the tool 10 is to be operated in accordance with bump-firing techniques, then operation of the tool 10 in the bump-firing mode can only proceed if the answer to the question posed at block 314 entitled IS TRIG-GER DEPRESSED? is YES as at 316, if the answer to the question posed at block 318 entitled IS SAFETY DEPRESSED? is YES as at 320, and if both trigger and workpiece contact element depression movements are accomplished within the aforenoted predetermined time period of 1–4 seconds because then not only is sufficient pressure maintained within the reservoir tank 80 but pressure within reservoir tank 80 is regenerated as at block 322 entitled FILL TANK whereupon a fastener is fired or discharged and the tool 10 is then ready to enter another firing or discharge cycle along line 274 and at box 276 entitled TOOL CYCLES. With the trigger member 64 constantly depressed, the workpiece contact element 58 is released as at 300 and operation of the tool 10 proceeds along flow lines 302,304,308,310,314, and 316.

If the trigger member 64 was not depressed as at steps 314,316, then the operative cycle proceeds along flow lines 324,326 and back to flow line 302 because it must be ascertained whether or not too much time has expired or lapsed before the trigger member 64 was depressed. If too much time has expired or lapsed, that is, for example, more than the aforenoted 1–4 seconds, then sufficient air pressure is no longer present within reservoir tank 80, and in accordance with flow line 306, initialization of the tool 10 must be restarted at box 250 entitled BEGIN. If sufficient pressure is still present within the reservoir tank 80 as at 308, operation of the tool 10 can proceed along line 308 whereby depression of the trigger member 64 and workpiece contact element 58 must be accomplished before expiration of the aforenoted time period. In a similar manner, if the trigger member 64 was depressed within the prescribed time period, but the workpiece contact element 58 was not depressed as at flow line 328, then the operative cycle of the tool 10 must again proceed along flow lines 326 and 302 so as to again determine if sufficient pressure is present within the reservoir tank 80. If not, the tool 10 must be initialized per flow line 306 and step 250 BEGIN. If sufficient pressure is still present within the reservoir tank 80 as at 308, operation of the tool 10 can proceed along line 308 whereby depression of the trigger member 64 and workpiece contact element 58 must be accomplished before expiration of the aforenoted time period so that the tool 10 can continue to be used in accordance with bump-firing techniques. After each fastener is fired or discharged, the trigger member 64 is maintained depressed as at 316 and 292, however, the workpiece contact element 58 is released as at 300, and with the trigger member maintained depressed as at 316, a new fastener can be fired or discharged each time the workpiece contact element 58 is again depressed as at 320.

If the tool 10 is to be operated in accordance with trigger-firing techniques along flow line 312, then the workpiece contact element 58 is constantly depressed against a workpiece and the trigger member 64 is periodically actuated or depressed. Accordingly, if the answer to the question posed at box 330 entitled IS SAFETY DEPRESSED? is YES as at 332, then the reservoir tank 80 is again pressurized as at box 334 entitled FILL TANK and operation of the tool 10 can proceed along flow line 336 whereupon each time the trigger member 64 is depressed as at flow line 338 a fastener is fired or discharged and the tool 10 recycles along flow line 274 and box 276 entitled TOOL CYCLES. While the workpiece contact element 58 is maintained in contact with the workpiece but moved from a first workpiece location to a second workpiece location, the trigger member 64 is released as at 298 and operation of the tool 10 proceeds along flow lines 302,304,308,312,330,332,334, and 336. If the workpiece contact element 58 was not maintained in contact with the workpiece as at 340, then the tool 10 is operated along flow line 342 and back to flow line 302 and step 304 so as to ascertain whether or not sufficient air pressure is present within the reservoir tank 80. If not, initialization of the tool 10 must be restarted along flow line 306 and at the BEGIN step 250. If sufficient pressure is present within reservoir tank 80, the workpiece contact element 58 must be depressed against the workpiece as at 330,332 within the aforenoted predetermined time period in order to ensure that sufficient pressure remains within reservoir tank 80 as at step 334. Once the workpiece contact element 58 is disposed or maintained in contact with the workpiece as at 332, if the trigger member 64 is not depressed as at 344, then the operator must return to line 336 per flow line 346.

Thus, it may be seen that in accordance with the teachings and principles of the present invention, a new and improved pneumatic fastener-driving tool has been developed wherein not only rapid-fire bump-firing or trigger-firing modes of operation are permitted wherein either one of the trigger member and workpiece contact element components can be depressed before the other one of the trigger member and workpiece contact element components depending upon the particular mode of operation that the operator personnel chooses to employ, however, the tool is also rendered safe for transportation by operator personnel between job sites or work sites in view of the fact that if the workpiece contact element is not depressed, as a result of not being disposed in contact or engagement with a workpiece, within a predetermined period of time subsequent to the performance of the last fastener discharge or firing operation, then the tool is pneumatically disabled and can only be again enabled if the proper sequential activation of the tool is performed wherein the workpiece contact element must be engaged with a workpiece prior to the depression or activation of the tool trigger. Accordingly, after the expiration or lapse of the aforenoted predetermined period of time, should the operator personnel carry or transport the tool with the trigger member nevertheless depressed, the tool will not fire or discharge a fastener even if the workpiece contact element is depressed due to the fact that the tool has already been pneumatically disabled. Accidental, inadvertent, and unintentional discharge or firing of the tool is therefore effectively prevented.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A pneumatic fastener driving tool having a magazine housing a plurality of fasteners to be driven, comprising:

a source of compressed air;

a main valve for causing the firing of a fastener from a tool magazine when said main valve is vented to atmosphere;

a pilot valve assembly comprising a pilot valve member movably mounted upon said pilot valve assembly between a first position at which a first fluid flow path from said source of compressed air to said main valve is defined within said pilot valve assembly so as to permit pressurization of said main valve with said compressed air in preparation for firing a fastener from the tool magazine, and a second position at which a second fluid flow path from said main valve to atmosphere is defined within said pilot valve assembly so as to permit venting of said compressed air from said main valve when a fastener from the tool magazine is to be fired;

a tool trigger movable between depressed and released states;

a workpiece contact element movable between depressed and released states; and fluid flow control means for enabling said tool to fire a fastener during a first fastener-firing operational cycle of said tool only if said workpiece contact element is sequentially depressed prior to the depression of said tool trigger, for enabling said tool to fire a fastener during a fastener-firing operational cycle of said tool subsequent to said first fastener-firing operational cycle of said tool regardless of the sequence in which said tool trigger is depressed with respect to the depression of said workpiece contact element, and for disabling said tool such that said tool cannot fire a fastener during an intended fastener-firing operational cycle of said tool if subsequent to said first fastener-firing operational cycle of said tool, said work-piece contact element is not moved to its depressed state within a predetermined period of time.

2. A pneumatic fastener driving tool as set forth in claim 1, wherein:

said tool trigger and said workpiece contact element are operatively connected to said valve member of said pilot valve assembly so as to move said valve member of said pilot valve assembly from said first position to said second position when both said tool trigger and said workpiece contact element are disposed in their depressed states.

3. A pneumatic fastener driving tool as set forth in claim 2, wherein:

said tool trigger and said workpiece contact element are operatively connected to said valve member of said pilot valve assembly such that movement of only one of said tool trigger and said workpiece contact element to its respective depressed state is unable to move said valve member of said pilot valve assembly from said first position to said second position.

4. A pneumatic fastener driving tool as set forth in claim 1, further comprising:

an air reservoir tank;

a fill valve assembly comprising a fill valve member movably mounted upon said air reservoir tank between a first position at which said air reservoir tank is fluidically disconnected from said source of compressed air, and a second position at which said air reservoir tank is fluidically connected to said source of compressed air.

5. A pneumatic fastener driving tool as set forth in claim 4, further comprising:

linkage structure operatively connecting said workpiece contact element to said fill valve member such that when said workpiece contact element is disposed in said depressed state, said fill valve member is moved to said second position so as to fluidically connect said air reservoir tank to said source of compressed air.

6. A pneumatic fastener driving tool as set forth in claim 5, further comprising:

an enable valve assembly fluidically interposed between said pilot valve assembly and said main valve, and comprising an enable valve member movably disposed within said enable valve assembly between a first closed position at which fluidic communication between said pilot valve assembly and said main valve is prevented, and a second opened position at which fluidic communication between said pilot valve assembly and said main valve is permitted;

a fluid conduit fluidically connecting said pilot valve assembly to said enable valve assembly for conveying compressed air from said source of compressed air along said first fluid flow path through said pilot valve assembly and to said enable valve assembly when said pilot valve member is disposed at said first position such that said compressed air can move said enable valve member from said first closed position to said second opened position so as to permit compressed air to be charged into said main valve; and an air signal line having a first end portion thereof fluidically connected to said air reservoir tank and having a second end portion thereof fluidically connected to said enable valve assembly for conveying a compressed air signal from said air reservoir tank to said enable valve assembly so as to maintain said enable valve member at said second opened position when said pilot valve member is disposed at said second position at which said first fluid flow path through said pilot valve assembly is closed and said second fluid flow path through said pilot valve assembly is opened so as to permit said compressed air disposed within said main valve to be vented from said main valve, through said fluid conduit, and along said second fluid flow path through said pilot valve assembly to atmosphere.

7. A pneumatic fastener driving tool as set forth in claim 6, further comprising:

a relief valve assembly fluidically connected to said air reservoir tank and comprising a poppet valve member movable between a first closed position at which compressed air from said compressed air source is permitted to accumulate within said air reservoir tank such that said compressed air can be transmitted to said enable valve assembly by said air signal line, and a second opened position at which said air reservoir tank is vented to atmosphere such that said compressed air cannot accumulate with said air reservoir tank and cannot be transmitted to said enable valve assembly by said air signal line.

8. A pneumatic fastener driving tool as set forth in claim 7, further comprising:

a first spring member having a first end portion thereof operatively engaged with a wall portion of said air reservoir tank and having a second end portion thereof operatively engaged with a first side of said poppet valve member for biasing said poppet valve member toward said first closed position; and a second spring member having a first end portion thereof operatively engaged with said tool trigger and having a second end portion thereof operatively engaged with a second opposite side of said poppet valve member for biasing said poppet valve member toward said second opened position;

said first and second spring members having force characteristics wherein the biasing force of said first spring member is greater than the biasing force of said second spring member such that said poppet valve member is normally disposed at said first closed position when said tool trigger is disposed at said released state, said poppet valve member will be moved to said second opened position when said tool trigger is moved to said depressed state and said air reservoir tank is not pressurized to a predetermined degree with said compressed air from said source of compressed air, and said poppet valve member will be retained at said first closed position when said tool trigger is moved to said depressed state and said air reservoir tank is pressurized to a predetermined degree with said compressed air from said source of compressed air, whereby during said first fastener-firing operational cycle of said tool, said workpiece contact element must be moved to said depressed state prior to movement of said tool trigger to said depressed state so as to permit said linkage structure to actuate said fill valve member whereby said air reservoir tank can be pressurized with said compressed air from said source of compressed air.

9. A pneumatic fastener driving tool as set forth in claim 8, further comprising:

a bleed orifice fluidically connecting said air reservoir tank to atmosphere for bleeding compressed air from said air reservoir tank to atmosphere at a predetermined rate, whereby if additional compressed air is permitted to enter said air reservoir tank, so as to replenish compressed air bled from said air reservoir tank, subsequent to said first fastener-firing operational cycle of said tool, by moving said work-piece contact element to said depressed state within said predetermined period of time so as to activate said fill valve member and thereby permit said additional compressed air to enter said air reservoir tank, said compressed air within said air reservoir tank will cooperate with said first spring member so as to retain said poppet valve at said first closed position, and said compressed air signal will be transmitted to said enable valve whereby said tool will be permitted to operate in either one of two rapid fire modes of operation.

10. A pneumatic fastener driving tool as set forth in claim 9, wherein:

a first one of said two rapid-fire modes of operation comprises a bump-fire mode of operation wherein after said tool trigger is moved to and retained in its depressed state, said workpiece contact element is subsequently and repeatedly moved to its depressed state with each movement of said workpiece contact element to said depressed state occurring within said predetermined period of time.

11. A pneumatic fastener driving tool as set forth in claim 9, wherein:

a second one of said two rapid-fire modes of operation comprises a trigger-fire mode of operation wherein after said workpiece contact element is moved to and retained in its depressed state, said tool trigger is repeatedly moved to its depressed state.

12. A pneumatic fastener driving tool as set forth in claim 5, further comprising:

a bleed orifice fluidically connecting said air reservoir tank to atmosphere for bleeding compressed air from said air reservoir tank to atmosphere at a predetermined rate, whereby if additional compressed air is permitted to enter said air reservoir tank, so as to replenish compressed air bled from said air reservoir tank, subsequent to said first fastener-firing operational cycle of said tool, by moving said work-piece contact element to said depressed state within said predetermined period of time so as to activate said fill valve member and thereby permit said additional compressed air to enter said air reservoir tank, said tool will be permitted to operate in either one of two rapid fire modes of operation.

13. A pneumatic fastener driving tool as set forth in claim 12, wherein:

a first one of said two rapid-fire modes of operation comprises a bump-fire mode of operation wherein after said tool trigger is moved to and retained in its depressed state, said workpiece contact element is subsequently and repeatedly moved to its depressed state with each movement of said workpiece contact element to said depressed state occurring within said predetermined period of time.

14. A pneumatic fastener driving tool as set forth in claim 13, wherein:

said predetermined period of time comprises 1–4 seconds.

15. A pneumatic fastener driving tool as set forth in claim 12, wherein:

a second one of said two rapid-fire modes of operation comprises a trigger-fire mode of operation wherein after said workpiece contact element is moved to and retained in its depressed state, said tool trigger is repeatedly moved to its depressed state.

16. A pneumatic fastener driving tool as set forth in claim 12, wherein:

said predetermined period of time comprises 1–4 seconds.

17. A pneumatic fastener driving tool as set forth in claim 5, further comprising:

a bleed orifice fluidically connecting said air reservoir tank to atmosphere for bleeding compressed air from said air reservoir tank to atmosphere at a predetermined rate, whereby if additional compressed air is not permitted to enter said air reservoir tank, so as to replenish compressed air bled from said air reservoir tank, by moving said workpiece contact element to said depressed state within said predetermined period of time so as to activate said fill valve member and thereby permit said additional compressed air to enter said air reservoir tank, said tool will be disabled.

18. A pneumatic fastener driving tool as set forth in claim 17, wherein:

said predetermined period of time comprises 1–4 seconds.

19. A pneumatic fastener driving tool as set forth in claim 17, further comprising:

a filter member interposed between said source of compressed air and said fill valve member so as to prevent fouling of said fill valve member.

20. A pneumatic fastener driving tool as set forth in claim 5, wherein said linkage structure comprises:

an actuator button integrally formed upon said fill valve;

a lever pivotally mounted upon said workpiece contact element;

a rotary shaft mounted upon said tool magazine;

a first flag member mounted upon a first end of said rotary shaft and engaged with said lever; and a second flag member mounted upon a second end of said rotary shaft and engaged with said fill valve whereby when said lever is pivotally moved when said workpiece contact element is depressed so as to pivot said first flag member and rotate said rotary shaft, said second flag member will pivot and actuate said fill valve.

21. A pneumatic fastener driving tool as set forth in claim 4, further comprising:

an enable valve assembly fluidically interposed between said pilot valve assembly and said main valve, and comprising an enable valve member movably disposed within said enable valve assembly between a first closed position at which fluidic communication between said pilot valve assembly and said main valve is prevented, and a second opened position at which fluidic communication between said pilot valve assembly and said main valve is permitted;

a fluid conduit fluidically connecting said pilot valve assembly to said enable valve assembly for conveying compressed air from said source of compressed air along said first fluid flow path through said pilot valve assembly and to said enable valve assembly when said pilot valve member is disposed at said first position such that said compressed air can move said enable valve member from said first closed position to said second opened position so as to permit compressed air to be charged into said main valve; and an air signal line having a first end portion thereof fluidically connected to said air reservoir tank and having a second end portion thereof fluidically connected to said enable valve assembly for conveying compressed air from said air reservoir tank to said enable valve assembly so as to maintain said enable valve member at said second opened position when said pilot valve member is disposed at said second position at which said first fluid flow path through said pilot valve assembly is closed and said second fluid flow path through said pilot valve assembly is opened so as to permit said compressed air disposed within said main valve to be vented from said main valve, through said fluid conduit, and along said second fluid flow path through said pilot valve assembly to atmosphere.

22. A pneumatic fastener driving tool as set forth in claim 6, further comprising:

a relief valve assembly fluidically connected to said air reservoir tank and comprising a poppet valve member movable between a first closed position at which compressed air from said compressed air source is permitted to accumulate within said air reservoir tank such that said compressed air can be transmitted to said enable valve assembly by said air signal line, and a second opened position at which said air reservoir tank is vented to atmosphere such that said compressed air cannot accumulate with said air reservoir tank and cannot be transmitted to said enable valve assembly by said air signal line.

23. A pneumatic fastener driving tool as set forth in claim 22, further comprising:

a first spring member having a first end portion thereof operatively engaged with a wall portion of said air reservoir tank and having a second end portion thereof operatively engaged with a first side of said poppet valve member for biasing said poppet valve member toward said first closed position;

a second spring member having a first end portion thereof operatively engaged with said tool trigger and having a second end portion thereof operatively engaged with a second opposite side of said poppet valve member for biasing said poppet valve member toward said second opened position;

said first and second spring members having force characteristics wherein the biasing force of said first spring member is greater than the biasing force of said second spring member such that said poppet valve member is normally disposed at said first closed position when said tool trigger is disposed at said released state, said poppet valve member will be moved to said second opened position when said tool trigger is moved to said depressed state and said air reservoir tank is not pressurized to a predetermined degree with said compressed air from said source of compressed air, and said poppet valve member will be retained at said first closed position when said tool trigger is moved to said depressed state and said air reservoir tank is pressurized to a predetermined degree with said compressed air from said source of compressed air.

24. A pneumatic fastener driving tool as set forth in claim 4, further comprising:

a filter member interposed between said source of compressed air and said fill valve member so as to prevent fouling of said fill valve member.

25. A pneumatic fastener driving tool as set forth in claim 1, wherein:

said predetermined period of time comprises 1–4 seconds.

26. A pneumatic fastener driving tool having a magazine housing a plurality of fasteners to be driven, comprising:

a source of compressed air;

a main valve for causing the firing of a fastener from a tool magazine when said main valve is vented to atmosphere;

a pilot valve assembly comprising a pilot valve member movably mounted upon said pilot valve assembly between a first position at which a first fluid flow path from said source of compressed air to said main valve is defined within said pilot valve assembly so as to permit pressurization of said main valve with said compressed air in preparation for firing a fastener from the tool magazine, and a second position at which a second fluid flow path from said main valve to atmosphere is defined within said pilot valve assembly so as to permit venting of said compressed air from said main valve when a fastener from the tool magazine is to be fired;

a tool trigger movable between depressed and released states;

a workpiece contact element movable between depressed and released states; and fluid flow control means for enabling said tool to fire a fastener during a first fastener-firing operational cycle of said tool only if said workpiece contact element is sequentially depressed prior to the depression of said tool trigger, and for enabling said tool to fire a fastener during a fastener-firing operational cycle of said tool subsequent to said first fastener-firing operational cycle of said tool regardless of the sequence in which said tool trigger is depressed with respect to the depression of said workpiece contact element only if said workpiece contact element is moved to its depressed state within a predetermined period of time, otherwise said tool is disabled.

27. A pneumatic fastener driving tool as set forth in claim 26, wherein:

said tool trigger and said workpiece contact element are operatively connected to said valve member of said pilot valve assembly so as to move said valve member of said pilot valve assembly from said first position to said second position when both said tool trigger and said workpiece contact element are disposed in their depressed states.

28. A pneumatic fastener driving tool as set forth in claim 26, wherein:

said tool trigger and said workpiece contact element are operatively connected to said valve member of said pilot valve assembly such that movement of only one of said tool trigger and said workpiece contact element to its respective depressed state is unable to move said valve member of said pilot valve assembly from said first position to said second position.

29. A pneumatic fastener driving tool as set forth in claim 26, further comprising:

an air reservoir tank;

a fill valve assembly comprising a fill valve member movably mounted upon said air reservoir tank between a first position at which said air reservoir tank is fluidically disconnected from said source of compressed air, and a second position at which said air reservoir tank is fluidically connected to said source of compressed air.

30. A pneumatic fastener driving tool as set forth in claim 29, further comprising:

linkage structure operatively connecting said workpiece contact element to said fill valve member such that when said workpiece contact element is disposed in said depressed state, said fill valve member is moved to said second position so as to fluidically connect said air reservoir tank to said source of compressed air.

31. A pneumatic fastener driving tool as set forth in claim 30, further comprising:

an enable valve assembly fluidically interposed between said pilot valve assembly and said main valve, and comprising an enable valve member movably disposed within said enable valve assembly between a first closed position at which fluidic communication between said pilot valve assembly and said main valve is prevented, and a second opened position at which fluidic communication between said pilot valve assembly and said main valve is permitted;

a fluid conduit fluidically connecting said pilot valve assembly to said enable valve assembly for conveying compressed air from said source of compressed air along said first fluid flow path through said pilot valve assembly and to said enable valve assembly when said pilot valve member is disposed at said first position such that said compressed air can move said enable valve member from said first closed position to said second opened position so as to permit compressed air to be charged into said main valve; and an air signal line having a first end portion thereof fluidically connected to said air reservoir tank and having a second end portion thereof fluidically connected to said enable valve assembly for conveying a compressed air signal from said air reservoir tank to said enable valve assembly so as to maintain said enable valve member at said second opened position when said pilot valve member is disposed at said second position at which said first fluid flow path through said pilot valve assembly is closed and said second fluid flow path through said pilot valve assembly is opened so as to permit said compressed air disposed within said main valve to be vented from said main valve, through said fluid conduit, and along said second fluid flow path through said pilot valve assembly to atmosphere.

32. A pneumatic fastener driving tool as set forth in claim 31, further comprising:

a relief valve assembly fluidically connected to said air reservoir tank and comprising a poppet valve member movable between a first closed position at which compressed air from said compressed air source is permitted to accumulate within said air reservoir tank such that said compressed air can be transmitted to said enable valve assembly by said air signal line, and a second opened position at which said air reservoir tank is vented to atmosphere such that said compressed air cannot accumulate with said air reservoir tank and cannot be transmitted to said enable valve assembly by said air signal line.

33. A pneumatic fastener driving tool as set forth in claim 32, further comprising:

a first spring member having a first end portion thereof operatively engaged with a wall portion of said air reservoir tank and having a second end portion thereof operatively engaged with a first side of said poppet valve member for biasing said poppet valve member toward said first closed position; and a second spring member having a first end portion thereof operatively engaged with said tool trigger and having a second end portion thereof operatively engaged with a second opposite side of said poppet valve member for biasing said poppet valve member toward said second opened position;

said first and second spring members having force characteristics wherein the biasing force of said first spring member is greater than the biasing force of said second spring member such that said poppet valve member is normally disposed at said first closed position when said tool trigger is disposed at said released state, said poppet valve member will be moved to said second opened position when said tool trigger is moved to said depressed state and said air reservoir tank is not pressurized to a predetermined degree with said compressed air from said source of compressed air, and said poppet valve member will be retained at said first closed position when said tool trigger is moved to said depressed state and said air reservoir tank is pressurized to a predetermined degree with said compressed air from said source of compressed air, whereby during said first fastener-firing operational cycle of said tool, said workpiece contact element must be moved to said depressed state prior to movement of said tool trigger to said depressed state so as to permit said linkage structure to actuate said fill valve member whereby said air reservoir tank can be pressurized with said compressed air from said source of compressed air.

34. A pneumatic fastener driving tool as set forth in claim 30, further comprising:

a bleed orifice fluidically connecting said air reservoir tank to atmosphere for bleeding compressed air from said air reservoir tank to atmosphere at a predetermined rate, whereby if additional compressed air is permitted to enter said air reservoir tank, so as to replenish compressed air bled from said air reservoir tank, subsequent to said first fastener-firing operational cycle of said tool, by moving said work-piece contact element to said depressed state within said predetermined period of time so as to activate said fill valve member and thereby permit said additional compressed air to enter said air reservoir tank, said tool will be permitted to operate in either one of two rapid fire modes of operation.

35. A pneumatic fastener driving tool as set forth in claim 34, wherein:

a first one of said two rapid-fire modes of operation comprises a bump-fire mode of operation wherein after said tool trigger is moved to and retained in its depressed state, said workpiece contact element is subsequently and repeatedly moved to its depressed state with each movement of said workpiece contact element to said depressed state occurring within said predetermined period of time.

36. A pneumatic fastener driving tool as set forth in claim 34, wherein:

a second one of said two rapid-fire modes of operation comprises a trigger-fire mode of operation wherein after said workpiece contact element is moved to and retained in its depressed state, said tool trigger is repeatedly moved to its depressed state.

37. A pneumatic fastener driving tool as set forth in claim 30, further comprising:

a bleed orifice fluidically connecting said air reservoir tank to atmosphere for bleeding compressed air from said air reservoir tank to atmosphere at a predetermined rate, whereby if additional compressed air is not permitted to enter said air reservoir tank, so as to replenish compressed air bled from said air reservoir tank, by moving said workpiece contact element to said depressed state within said predetermined period of time so as to activate said fill valve member and thereby permit said additional compressed air to enter said air reservoir tank, said tool will be disabled.

38. A pneumatic fastener driving tool as set forth in claim 30, wherein said linkage structure comprises:

an actuator button integrally formed upon said fill valve;

a lever pivotally mounted upon said workpiece contact element;

a rotary shaft mounted upon said tool magazine;

a first flag member mounted upon a first end of said rotary shaft and engaged with said lever; and a second flag member mounted upon a second end of said rotary shaft and engaged with said fill valve whereby when said lever is pivotally moved when said workpiece contact element is depressed so as to pivot said first flag member and rotate said rotary shaft, said second flag member will pivot and actuate said fill valve.

39. A pneumatic fastener driving tool as set forth in claim 26, wherein:

said predetermined period of time comprises 1–4 seconds.

* * * * *